US006371671B1

(12) United States Patent
Sato et al.

(10) Patent No.: US 6,371,671 B1
(45) Date of Patent: Apr. 16, 2002

(54) KEY SWITCH DEVICE, KEYBOARD WITH THE KEY SWITCH DEVICE, AND ELECTRONIC APPARATUS WITH THE KEYBOARD

(75) Inventors: Hirofumi Sato; Isao Mochizuki, both of Gifu (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/514,588

(22) Filed: Feb. 28, 2000

(30) Foreign Application Priority Data

Mar. 1, 1999 (JP) ..... 11-053333
Jan. 11, 2000 (JP) ..... 2000-002064

(51) Int. Cl.[7] ..... B41J 5/12
(52) U.S. Cl. ..... 400/495; 400/472
(58) Field of Search ..... 400/495, 495.1, 400/490, 472, 492, 491.2, 491.1; 200/344, 345, 341

(56) References Cited

U.S. PATENT DOCUMENTS 5,813,521 A 9/1998 Koike et al. ..... 200/344

FOREIGN PATENT DOCUMENTS

| | | |
|---|---|---|
| DE | 40 39 379 C1 | 4/1992 |
| GB | 2315 162 A | 1/1998 |
| JP | 10-172380 | 6/1998 |
| JP | A-10-172380 | 6/1998 |
| JP | 11-32608 | 2/1999 |

*Primary Examiner*—John S. Hilten
*Assistant Examiner*—Anthony H. Nguyen
(74) *Attorney, Agent, or Firm*—Oliff & Berridge, PLC

(57) ABSTRACT

A key switch is configured such that each of a first cam portion 24 of a first link member 3 and a second cam portion 35 of a second link member 4 is provided with first and second cam surfaces 25, 26 and a cam apex 27. Plate springs 20, 31 are integrally provided in the first and second cam portions 24, 35 respectively. When a key top 2 is depressed, the urging force of the plate springs causes the first cam surfaces 25 of both the first and second cam portions to come into contact with each other. Thus the key top is securely held in the depressed position. When key top 2 is pressed the second cam surfaces 26 of the first and second cam portions 24, 35 come into contact with each other while the upward movement of the first and second link members 3, 4 is retained based on the urging force of the plate springs 20, 31, causing the elastic resinous pieces 24A, 35A to perform a switching operation.

29 Claims, 28 Drawing Sheets

KEY SWITCH DEVICE, KEYBOARD WITH THE KEY SWITCH DEVICE, AND ELECTRONIC APPARATUS WITH THE KEYBOARD

BACKGROUND OF THE INVENTION

1. Field of the Invention

The present invention relates to a key switch device having a key top which is guided up and down with a pair of link members to perform a switching action, a keyboard including the key switch device, and an electronic apparatus provided with the keyboard.

More particularly, the present invention relates to a key switch device which does not need a rubber spring generally used in a conventional key switch device and a complicated key top urging mechanism, and which can realize a key operation with a fine click touch in operating a key top and freely design the click touch, so that the cost of the whole key switch device can be reduced, and a keyboard provided with the key switch device and an electronic apparatus provided with the keyboard.

2. Description of Related Art

In association with the reduction in size, thickness, and others of a notebook-size personal computer which is one of electronic instruments, conventionally, there have been proposed various types of key switch devices used for a keyboard provided in the notebook-size personal computer. Such the key switch devices generally use a rubber spring for urging a key top upward and hold it in a non-pressed position (an "up" position), while buckles with a click when the key top is pressed down, then performing a switching operation, and returns the key top to the up position after the switching operation.

The rubber spring is usually made of one of silicon rubber, EPDM rubber, etc., which is in general high in cost and complex in properly assembling in place in the key switch device. The switching characteristics of the key switch device largely depend on the property of the rubber spring. The use of the rubber spring would therefore inhibit the flexible or free change of the switching characteristics of the key switch device.

In view of the circumstances, many proposals to realize a key switch device without use of a rubber spring have been presented in recent years. For instance, Japanese unexamined application laid-open No. 10-172380 discloses a key switch device in which a pair of a first and second links are movably arranged between a hook of a key top and a hook of a base mold to guide the key top in a vertical direction, and a rubber sheet stretched over between joint portions of the links. In such the key switch device, a circular projection formed on the back surface of the key top is made into close contact with the rubber sheet while the key top is not pressed, thus holding the key top in a non-pressed position. Upon pressure of the key top, the key top presses the rubber sheet downward through the circular projection as increasing a tension of the rubber sheet so that the rubber sheet projects downward through a through hole, thereby performing a switching operation, with a click, a switching area of a membrane sheet supported on a bottom plate.

It is to be noted that, on release of the pressure of the key top, the key top is moved upward by an elastic force of the rubber sheet to the original non-pressed position.

The above key switch device disclosed in Japanese unexamined application laid-open No. 10-172380, using no rubber spring, could achieve the increase in flexibility of key switch design without influence of the size of a rubber spring.

Although the above key switch device is not provided with a generally used rubber spring, however, the rubber sheet simply substitutes for the rubber spring. In view of the structure of the key switch device needing such the rubber sheet, the key switch device is still insufficient in reduction of cost of the whole key switch device. The work of stretching the rubber sheet over between the joints of the pair of links also would complicate the work of assembling the key switch device.

Although the above key switch device could perform a switching operation with a click touch when the key top is pressed down, it is difficult to provide a flexibly designed click touch.

SUMMARY OF THE INVENTION

The present invention has been made in view of the above circumstances and has an object to overcome the above problems and to provide a key switch device capable of performing a key operation with a fine click touch in operating a key top and also capable of providing a flexibly designed click touch, without needing a rubber spring and a complicated key top urging mechanism, thereby reducing the cost of the whole key switch device, and a keyboard provided with the key switch device and an electronic apparatus provided with the keyboard.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the purpose of the invention, there is provided a key switch device including a key top and a pair of first and second link members movably arranged under the key top, the first and second link members being used for guiding the key top in a vertical direction to perform a switching operation on a switching section, the device further including a first cam portion formed in the first link member, a second cam portion formed in the second link member, and an elastic portion formed in each of the first and second cam portions, for urging the first and second cam portions in a direction to come into contact with each other.

In the above key switch device, the first link member is provided with the first cam portion, the second link member is provided with the second cam portion, and the first and second cam portions are provided with the elastic portions for urging the first and second cam portions respectively in a direction of contacting with each other. By the contact state of the first cam portion of the first link member and the second cam portion of the second link member, and, the cooperation of the elastic portions of the first and second cam portions, the key top can be urged upward and held in the non-pressed position or be returned to the non-pressed position upon release of pressure of the key top. The key switch device is constructed with no use of a rubber spring and a complicated urging mechanism, so that the reduction in cost can be achieved.

The first and second cam portions are always in contact with each other through the elastic portions. The contact position therebetween varies with the vertical movement of the key top. Accordingly, change of the shapes of the first and second cam portions as required enables a flexible design of a click which generates in the key operation.

According to another aspect of the present invention, there is provided a keyboard to be used for inputting letters, symbols, and others, the keyboard including a key switch device that includes; a key top; a pair of first and second link members movably arranged under the key top, the first and second link members being used for guiding the key top in a vertical direction to perform a switching operation on a switching section; a first cam portion formed in the first link member; a second cam portion formed in the second link member; and an elastic portion formed in each of the first and second cam portions, for urging the first and second cam portions in a direction to come into contact with each other.

According to another aspect of the present invention, there is provided an electronic apparatus including a keyboard used for inputting letters, symbols, and others, the keyboard being provided with a key switch device that includes a key top, a pair of first and second link members movably arranged under the key top, the first and second link members being used for guiding the key top in a vertical direction to perform a switching operation on a switching section, a first cam portion formed in the first link member; a second cam portion formed in the second link member, and an elastic portion formed in each of the first and second cam portions, for urging the first and second cam portions in a direction to come into contact with each other; display means for displaying the letters, symbols, and others; and control means for controlling the display means to display the letters, symbols, and others based on input data from the keyboard.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

A detailed description of preferred embodiments of a key switch device, a keyboard provided with the key switch device, and an electronic apparatus provided with the keyboard, embodying the present invention will now be given referring to the accompanying drawings.

Figure 24A:
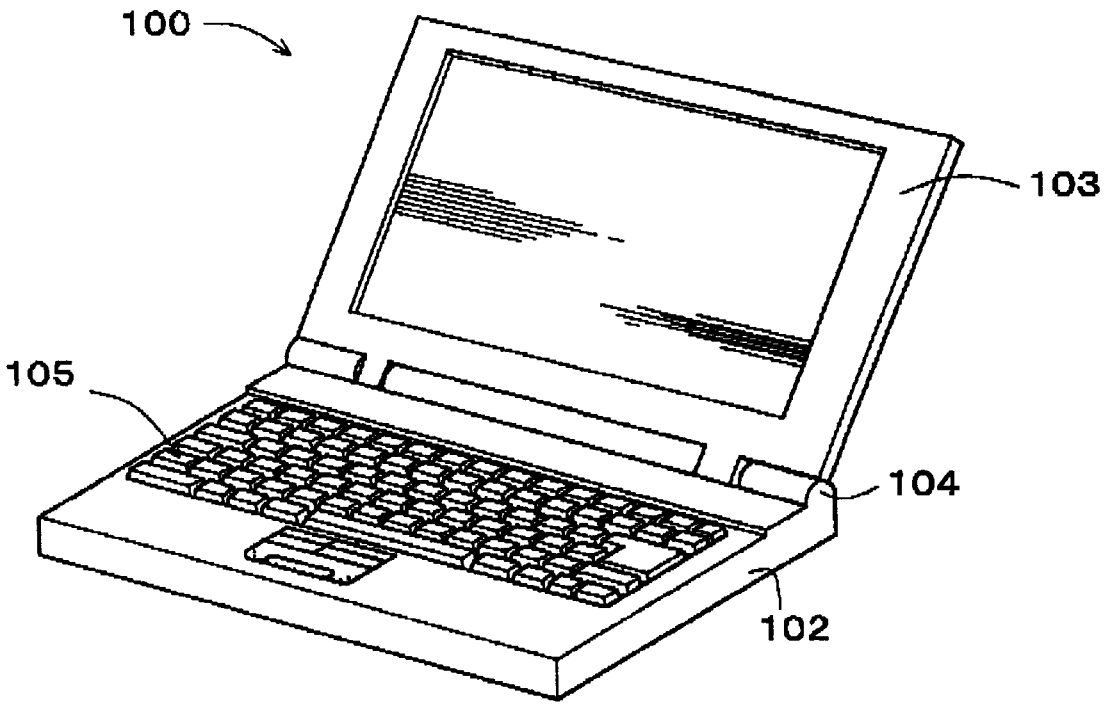
FIG. 24A is a perspective view of a notebook-size personal computer.
Figure 24B:
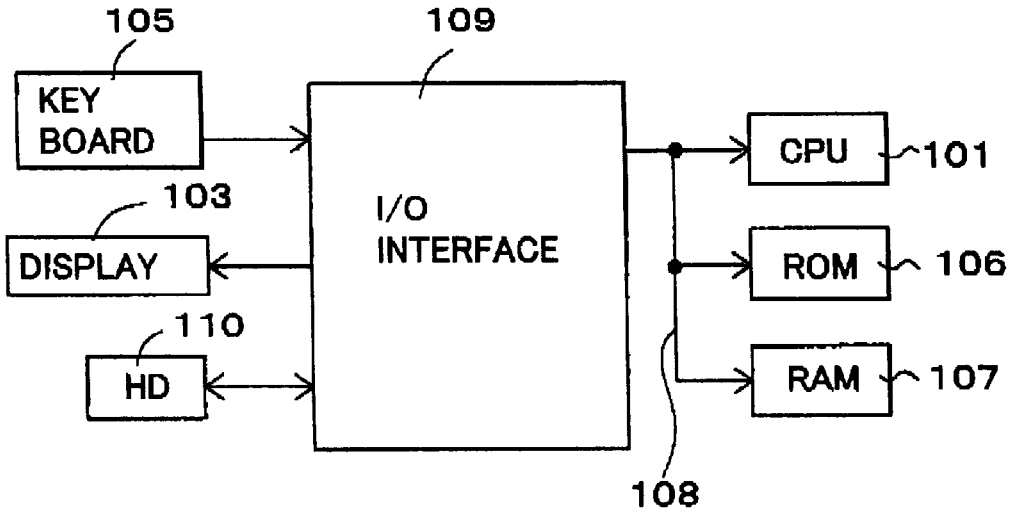
FIG. 24B is a block view of an electrical structure of the computer of FIG. 24A.

At first, explanation is made on a notebook-size personal computer which is one of an electronic apparatus in a first embodiment according to the present invention, referring to FIG. 24A and 24B. FIG. 24A is a perspective view of the notebook-size personal computer and FIG. 24B is a block view of an electrical structure of the computer.

In FIG. 24A, a notebook-size personal computer 100 is mainly composed of a main unit 102 including a CPU which conducts various processing and a display 103 supported on the main unit 102. This display 103 is pivotably connected to a joint portion 104 of the main unit 102 so that the display 103 is opened or closed with respect to the main unit 102. The main unit 102 is also provided with a keyboard 105 in which a plurality of key switch devices 1 are arranged.

As shown in FIG. 24B, the CPU 101 is connected through a bus 108 to a ROM 106 which stores programs for controlling each section of the personal computer 100 and a RAM 107 which stores various data. The CPU 101 is also connected to an input/output (I/O) interface 109 through the bus 108. To the I/O interface 109, connected are the display 103, the keyboard 105, and a hard disc 110 which stores programs such as a word processing program, a spreadsheet program, and others. The CPU 101 executes a program read out of the hard disc 110, such as the word processing program, the spreadsheet program, etc., and causes the display 103 to display letters or symbols.

Figure 1:
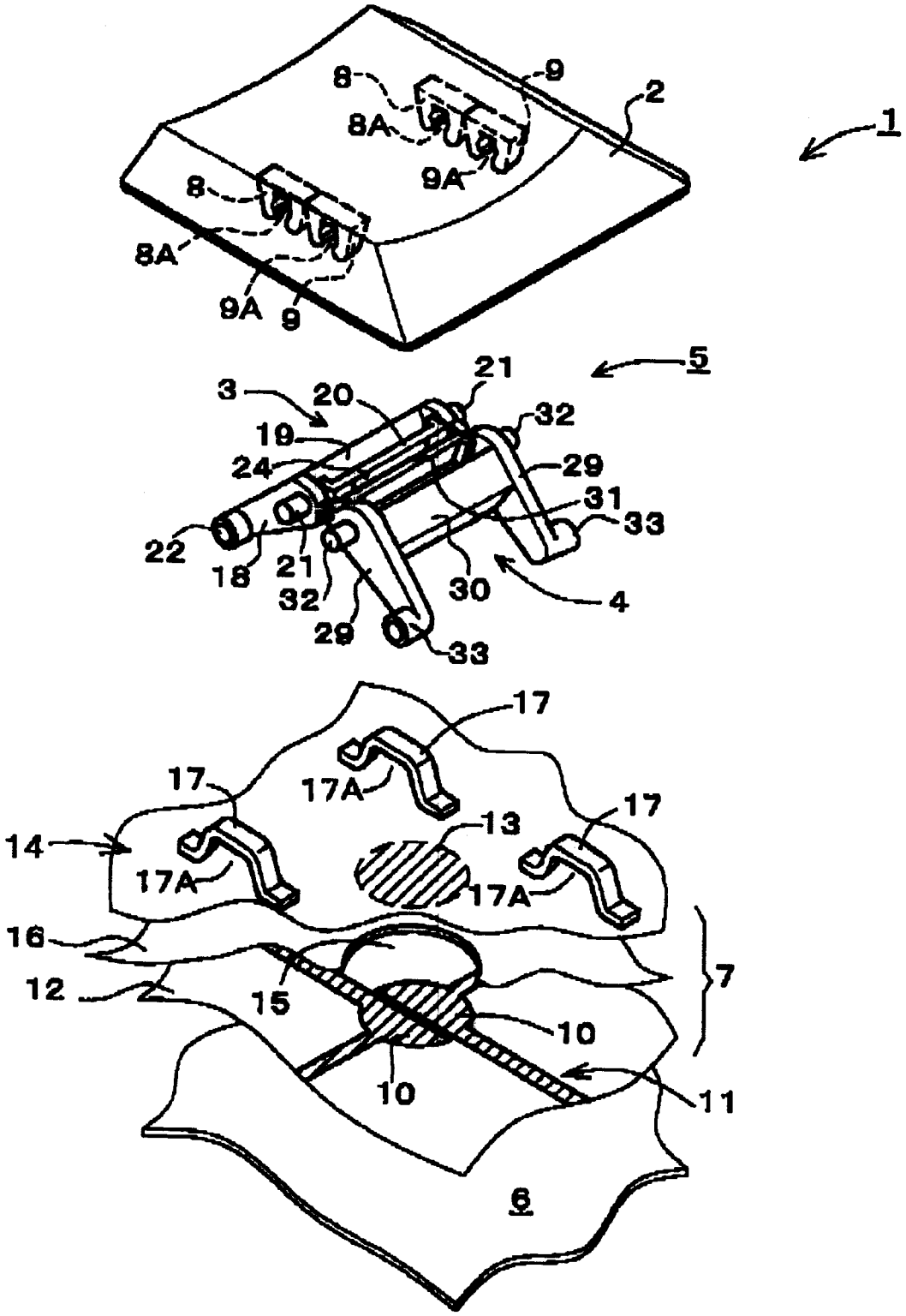
FIG. 1 is a perspective exploded view of a key switch device in a first embodiment according to the present invention.
Figure 2:
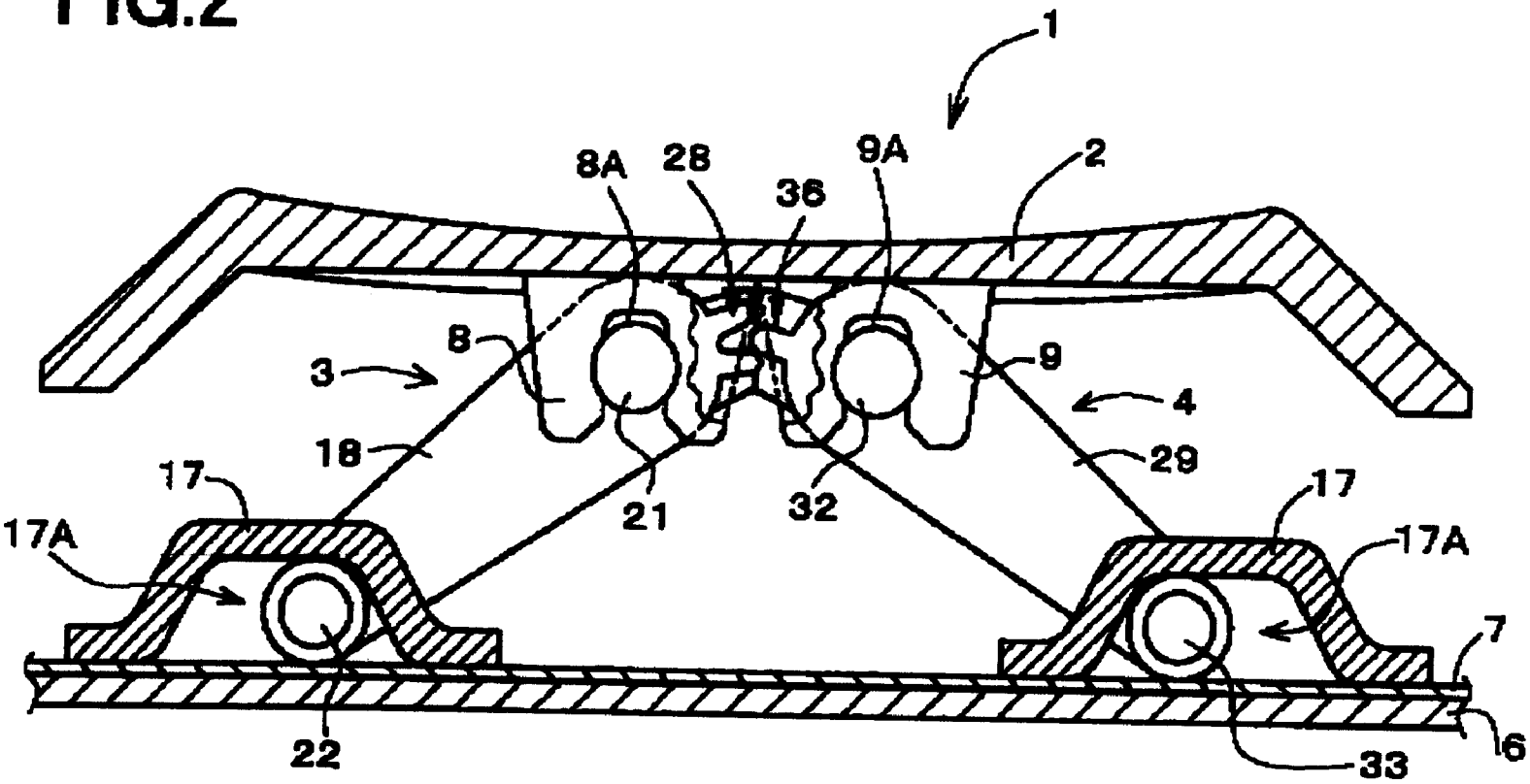
FIG. 2 is a schematic side view of the key switch device.
Figure 3:
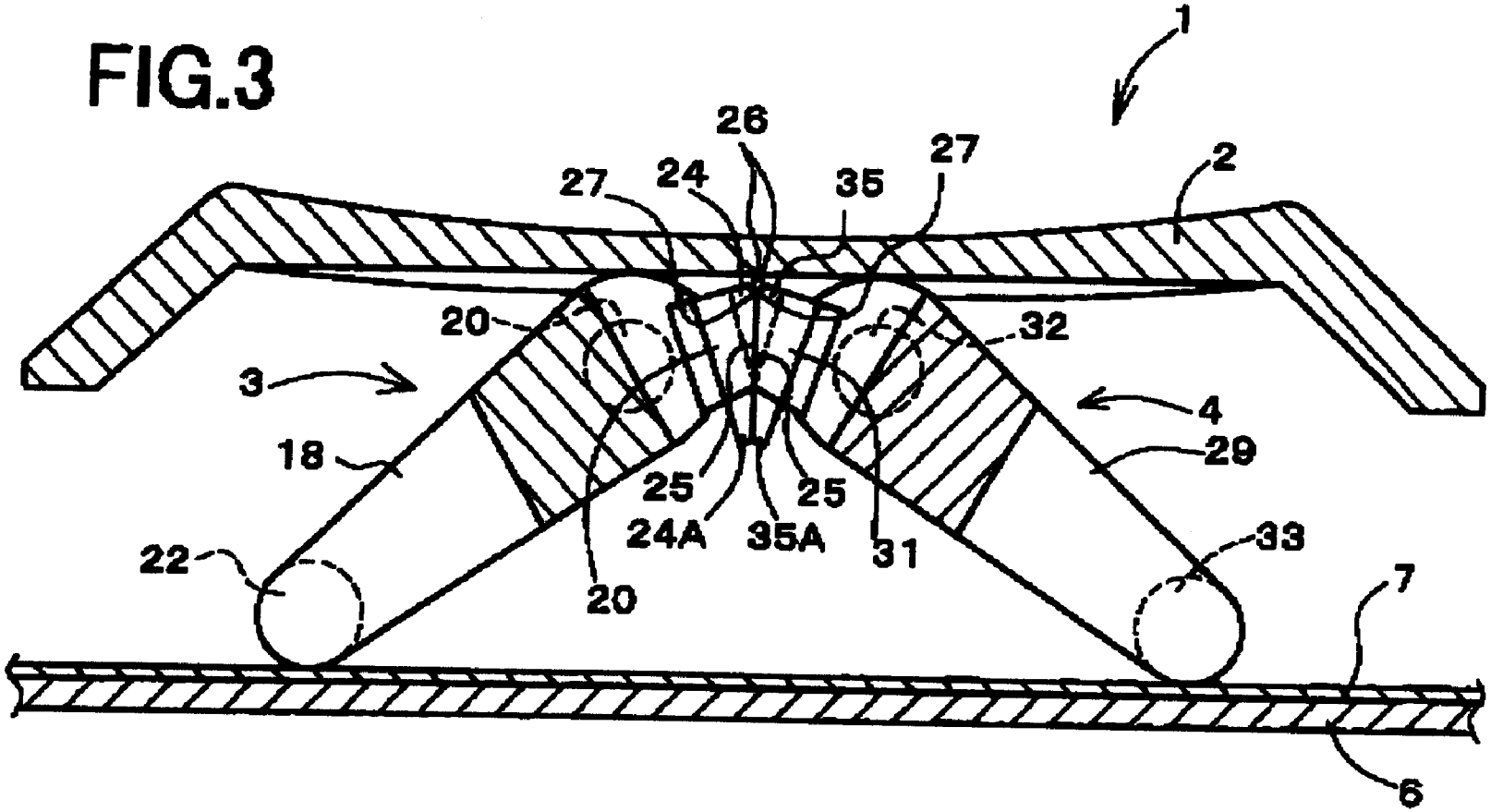
FIG. 3 is a schematic sectional side view of the key switch device.

Next explanation is made on a schematic structure of a key switch device in the first embodiment, provided in the keyboard 105 of the notebook-size personal computer 100, referring to FIGS. 1–3. FIG. 1 is a perspective exploded view of the key switch device in the first embodiment; FIG. 2 is a schematic side view of the key switch device; and FIG. 3 is a schematic sectional side view of the same.

In FIG. 1, the key switch device 1 is mainly constructed of a key top 2, a guide member 5 for guiding the vertical movement of the key top 2, and a membrane switch sheet 7 arranged on a support plate 6 positioned under the guide member 5. The guide member 5 is constructed of a pair of a first and second link members 3 and 4.

The key top 2 is made of ABS resin and the like and provided with a character such as a letter, numerical, etc. printed on the surface. On the back surface of the key top 2, two engagement portions 8, 8 corresponding to the first link member 3 are integrally provided with the key top 2 and also two engagement portions 9, 9 corresponding to the second link member 4 are integrally provided with the key top 2. Each of the engagement portions 8 and 9 has an engagement recess 8A, 9A. The engagement recess 8A of the engagement portion 8 rotatably supports a first shaft 21 (mentioned later) of the first link member 3. The engagement recess 9A of the engagement portion 9 rotatably supports a third shaft 32 (mentioned later) of the second link member 4.

The guide member 5 is constructed of the first and second link members 3 and 4 mutually assembled. Those first and second link members 3 and 4 have substantially the same configuration. The details of the first and second link members 3 and 4 will be mentioned later.

The membrane switch sheet 7 is disposed under the guide member and on the support plate 6 made of a metallic thin plate formed of one of aluminum, iron, and the like. The membrane switch sheet 7 has a three-layer configuration including a lower film sheet on which a switch circuit pattern 11 including a fixed electrode pattern 10 is formed of copper foil, electrically conductive coating, and the like, an upper film sheet 14 on which a movable electrode pattern 13 is similarly formed on the lower surface, and a film spacer 16 provided with a switching hole 15 positioned in correspondence with the fixed electrode pattern 10 and the movable electrode pattern 13 and arranged between the upper and lower film sheets 14 and 12. The structure of such the membrane switch sheet 7 has been well known.

Four chipped engagement members 17 made of one of metal, resin, etc. are arranged on the upper surface of the upper film sheet 14 so as to surround the movable electrode patter 13 and adhered on the upper film sheet 14 with adhesion. Each of the engagement members 17 has an elongated recess 17A in which a second shaft 22 (mentioned later) of the first link member 3 or a fourth shaft 33 (mentioned later) of the second link member 4 is slidably engaged. It is to be noted that the structure of adhering the engagement members 17 on the upper surface of the upper film sheet 14 is the same as the structure disclosed in the specification and drawings of Japanese patent application No. 11-32608 (corresponding to U.S. patent application Ser. No. 09/391,159). The detailed explanation thereof is referred to that application and is omitted therein.

Figure 4A:
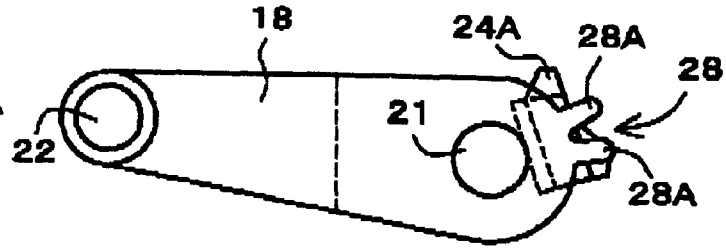
FIGS. 4A and 4C are side views of a first link member.
Figure 4B:
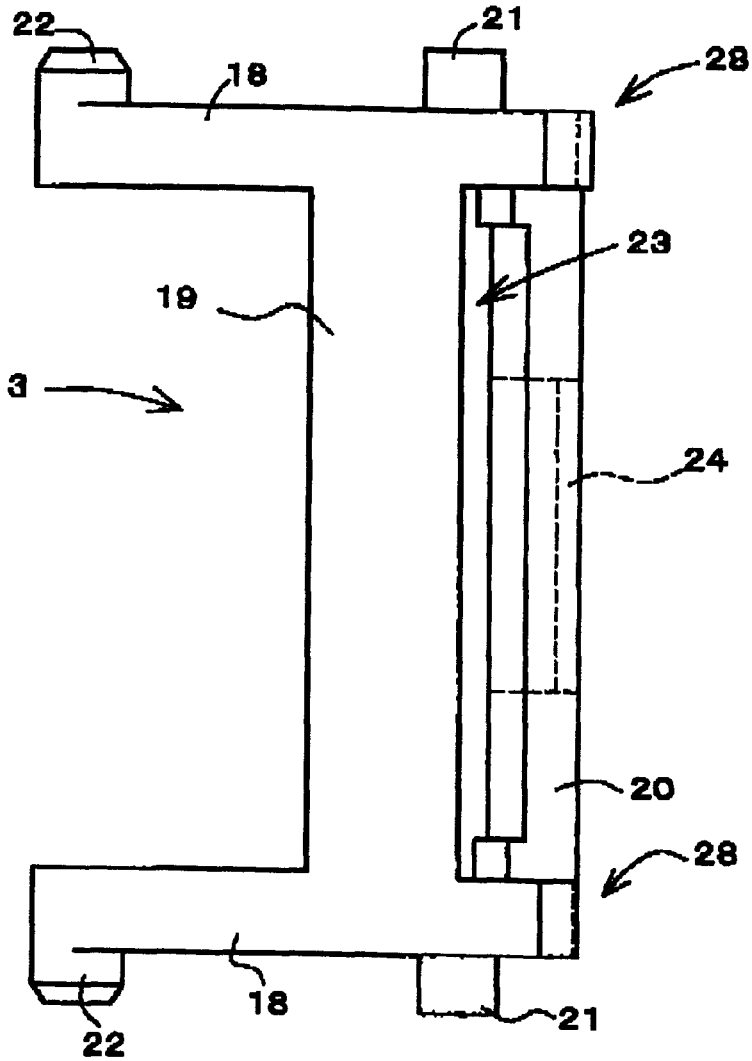
FIG. 4B is a top view of the first link member.
Figure 4C:
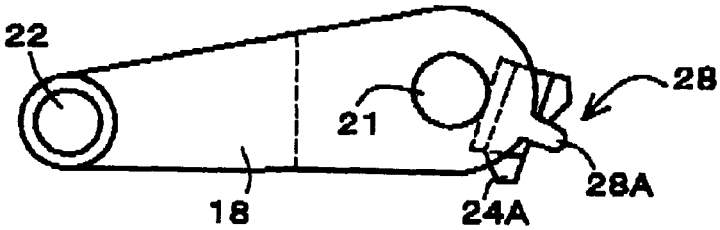

Next, the detailed structures of the first and second link members 3 and 4 forming the guide member 5 are described. The first link member 3 is first explained with reference to FIGS. 1 through 4. FIGS. 4A and 4C are side views of the first link member and FIG. 4B is a top view of the same.

The first link member 3 is structured of a pair of plate members 18, 18, a joint portion 19 joining the plate members 16, 18, and a plate spring 20 arranged near the joint portion 19, which are made, in one piece, of one of polyacetal resin, liquid crystal polymer, poly phenylene sulfide, poly butylene terephthalate etc. The first shaft 21 is provided in the plate member 18 so as to extend outward at a position near one end side thereof (i.e., in an upper end side in FIGS. 1–3; a right end side in FIG. 4). The second shaft 22 is provided in the plate member 18 so as to extend outward at a position near another end side (i.e., in a lower end side in FIGS. 1–3; a left end side in FIG. 4). The first shaft 21 is rotatably engaged in the recess 8A of the engagement portion 8 of the key top 2. The second shaft 22 is slidably engaged in the recess 17A of the engagement member 17 adhered on the upper surface of the upper film sheet 14 of the membrane switch sheet 7.

The joint portion 19 is to couple the plate members 18, 18 at a distance therebetween. The plate spring 20 is arranged between the plate members 18, 18, while keeping a fixed space 23 from the joint portion 19. A first cam portion 24 is formed into one body with the plate spring 20 in the substantial center. As shown in FIG. 3, the first cam portion 24 is provided with a first cam surface 25 in the lower side and a second cam surface 26 in the upper side, formed continuously upward from the first cam surface 25. A cam apex 27 is formed at the boundary between the first and second cam surfaces 25 and 26. The first cam surface 25, as is clear from FIG. 3, corresponds to a non-pressed position (an "up" position) of the key top 2. The second cam surface 26 corresponds to a pressed position (a "down" position) of the key top 2, as mentioned later. the angle defined by the first and second cam surface 25 and 26 with the cam apex 27 centrally positioned is set to an obtuse angle. The first cam portion 24 is also provided on the lower end, with an elastic resinous piece 24A used for performing a switching operation on the membrane switch sheet 7 when the key top 2 is pressed down.

Each of the plate members 16 is provided with a gear portion 28 arranged nearer the end of the plate member 18 than the first shaft 21 (i.e., in a right side in FIGS. 2 and 4). The gear portion 28 includes one tooth or two teeth 28A In the present embodiment, the upper plate member 18 (FIG. 4A) has the gear portion 28 of two teeth 28A and the lower plate member 18 (FIG. 4C) has the gear portion 28 of one tooth 28A. The gear portion 28, as will be mentioned later, engages with a gear portion 36 formed in the end of the plate member 29 of the second link member 4 to function for simultaneously operating the first and second link members 3 and 4 in association with the vertical movement of the key top 2.

Figure 5A:
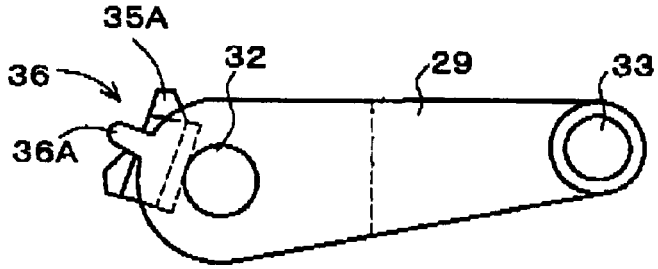
FIGS. 5A and 5C are side views of a second link member.
Figure 5B:
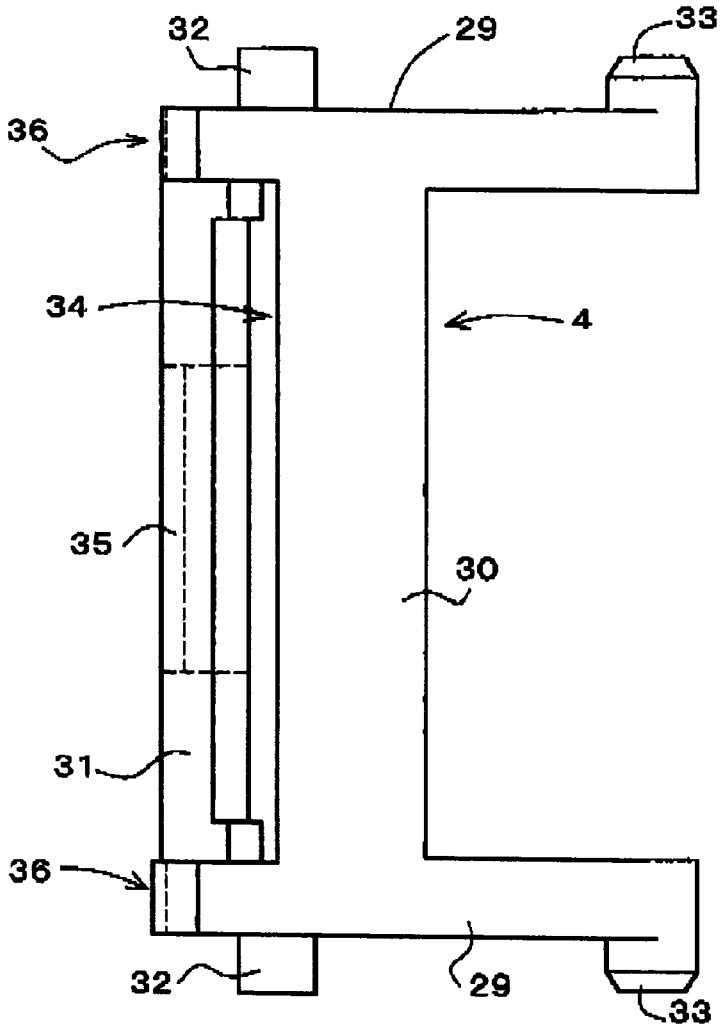
FIG. 5B is a top view of the second link member.
Figure 5C:
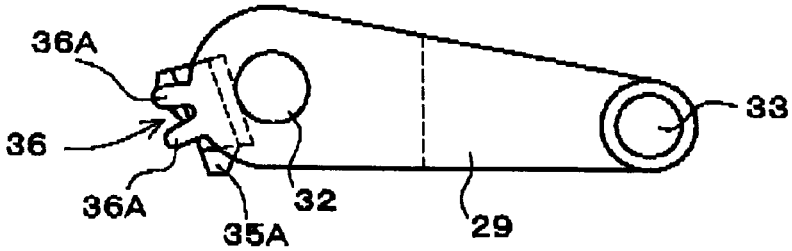

Next, the structure of the second link member 4 is described with reference to FIGS. 1 to 3 and FIG. 5. FIGS. 5A and 5C are side views of the second link member and FIG. 5B is a top view of the same. It is to be noted that the second link member 4 has substantially the same structure as that of the first link member 3.

The second link member 4 is structured of a pair of plate members 29, 29, a joint portion 30 joining the plate members 29, 29, and a plate spring 31 arranged near the joint portion 30, which are made, in one piece, of one of polyacetal resin, liquid crystal polymer, poly phenylene sulfide, poly butylene terephthalate, etc. The third shaft 32 is provided in the plate member 29 so as to extend outward at a position near one end side thereof (i.e., in an upper end side in FIGS. 1–3; a left end side in FIG. 5). The fourth shaft 33 is provided in the plate member 29 so as to extend outward at a position near another end side of the plate member 29 (i.e., in a lower end side in FIGS. 1–3; a right end side in FIG. 5). The third shaft 32 is rotatably engaged in the recess 9A of the engagement portion 9 of the key top 2. The fourth shaft 33 is slidably engaged in the recess 17A of the engagement member 17 adhered on the surface of the upper film sheet 14 of the membrane switch sheet 7.

The joint portion 30 is to couple the plate members 29, 29 at a distance therebetween. The plate spring 31 is arranged between the plate members 29, 29, while keeping a fixed gap 34 from the joint portion 30. A second cam portion 35 is formed into one body with the plate spring 31 in the substantial center. As shown in FIG. 3, similarly to the first cam portion 24, the second cam portion 35 is provided with a first cam surface 25 in the lower side and a second cam surface 26 formed continuously upward from the first cam surface 25. A cam apex 27 is formed at the boundary between the first and second cam surfaces 25 and 26. The first cam surface 25, as is clear from FIG. 3, corresponds to the non-pressed position (the "p" position) of the key top 2. The second cam surface 26 corresponds to the pressed position (the "down" position) of the key top 2, as mentioned later. The angle defined by the first and second cam surface 25 and 26 with the cam apex 27 centrally positioned is set to an obtuse angle. The second cam portion 35 is also provided, on the lower end, with an elastic resinous piece 35A used for performing a switching operation on the membrane switch sheet 7 when the key top 2 is pressed down.

The first cam surfaces 25 of the first and second cam portion 24 and 35 are in contact with each other in the non-pressed position of the key top 2 as shown in FIG. 3. In this state, the plate springs 20 and 31 of the respective first and second link members 3 and 4 urge the first and second cam portions 24 and 35 in a direction to come into contact with each other. This state where the first cam surfaces 25 of the first and second cam portions 24 and 35 are in contact with each other is regarded as "the first contact state". In this first contact state, the key top 2 is stably held in the non-pressed position.

Upon pressure of the key top 2, the first and second cam portions 24 and 35 are moved from the first contact state, passing the cam apexes 27, to the second contact state where the second cam surfaces 26 are made into contact with each other. In this second contact state, the key top 2 is in the pressed position, that is, one or both of the elastic resin pieces 24A and 35A press from above the movable electrode pattern 13 formed on the upper film sheet 14 of the membrane switch sheet 7. Thus, the movable electrode pattern 13 is brought into contact with the fixed electrode pattern 10 formed on the lower film sheet 12 through the switching hole 15 of the film spacer 16, thereby performing a predetermined switching operation.

Each of the plate members 29 is provided with a gear portion 36 arranged nearer the end of the plate member 29 than the third shaft 32 (i.e., in a left side in FIGS. 2 and 5). The gear portion 36 includes one tooth or two teeth 36A. In the present embodiment, the upper plate member 29 (FIG. 5A) has the gear portion 36 of one tooth 36A and the lower plate member 29 (FIG. 5C) has the gear portion 36 of two teeth 36A. The gear portion 36, as mentioned above, engages with the gear portion 28 formed in the end of the plate member 18 of the first link member 3 to function for simultaneously operating the first and second link members 3 and 4 in association with the vertical movement of the key top 2.

Figure 6A:
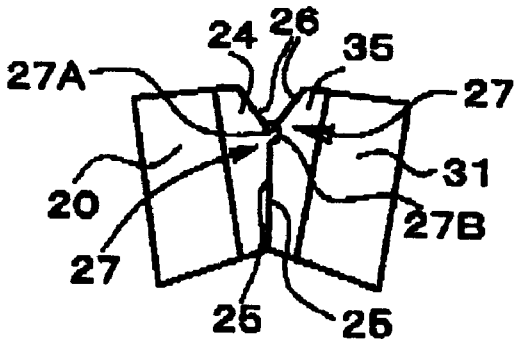
FIGS. 6A, 6B, and 6C are schematic explanatory views of a plate spring and a first cam portion of the first link member and a plate spring and a second cam portion of the second link member.
Figure 6B:
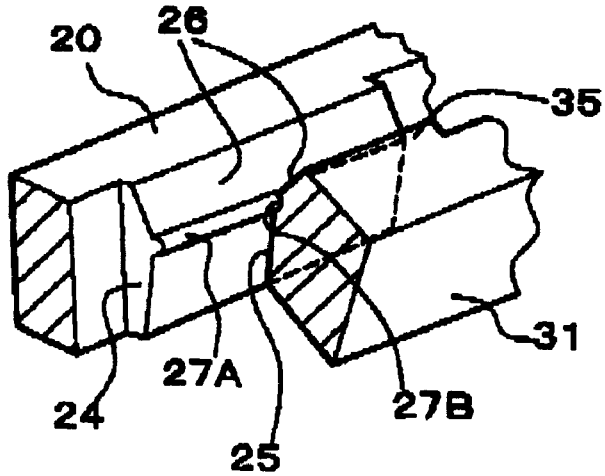
Figure 6C:
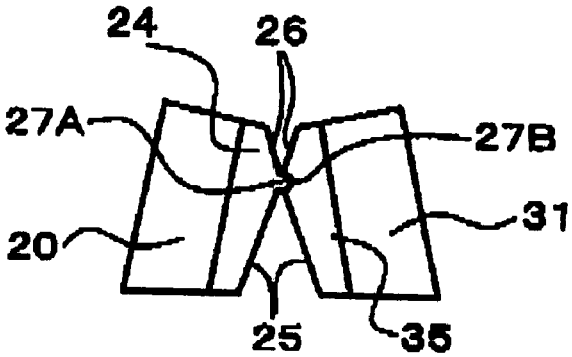

Next explanation is made on the relationship between the first and second cam portions 24 and 35 with reference to FIGS. 6A, 6B, and 6C are schematic explanatory views of the plate spring 20 and the first cam portion 24 of the first link member 3 and the plate spring 31 and the second cam portion 35 of the second link member 4.

In FIGS. 6A and 6B, the first cam portion 24 formed integrally with the plate spring 20 of the first link member 3 is provided with a projection 27A which is formed at the cam apex 27 of the cam portion 24 and extends throughout the width of the first cam portion 24. The second cam portion 35 integrally formed with the plate spring 31 of the second link member 4 is provided with a groove 27B which is formed at the cam apex 27 of the cam portion 35 and engaged with the projection 27A. As mentioned above, the plate springs 20 and 31 urges the first and second cam portions 24 and 35 to come into contact with each other. The projection 27A and the groove 27B are engaged all the time during from the first contact state where the first cam surfaces 25 of the first and second cam portions 24 and 35 are in contact with each other (see FIGS. 6A and 6B) to the second contact state where the second cam surfaces 26 are in contact with each other, by way of the state where the contact between the cam portions 24 and 35 passes the apexes 27, namely, the cam portions 24 and 35 are in contact with only the apexes 27 (see FIG. 6C). Thus, when the first and second link members 3 and 4 are moved in association with the vertical movement of the key top 2 during a key operation, the first and second cam portions 24 and 35 can be operated with secure synchronization between the first cam surfaces 25, the cam apexes 27, and the second cam surfaces 26.

The operation of the key switch device 1 constructed as above will be described hereinafter with reference to FIG. 7.

FIGS. 7A through 7D are schematic explanatory views of the first and second link members 3, 4 in a series of movements from non-pressed state of the key top 2 to the pressed state of performing the switching operation.

Figure 7A:
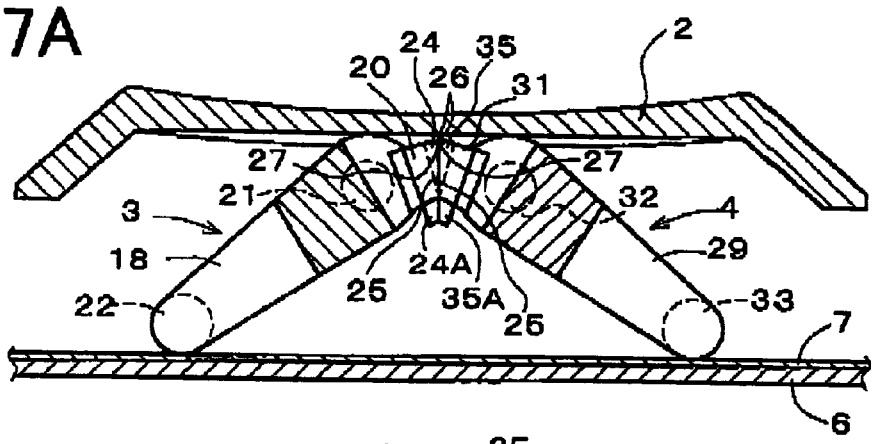
FIGS. 7A through 7D are schematic explanatory views of the first and second link members in a series of movements including a non-pressed state of a key top, a pressed state, and finally a switching state.

In the non-pressed state of the key top 2, the key top 2 is held in the non-pressed position as shown in FIG. 7A. In this state, the first cam surface 25 of the first cam portion 24 of the first link member 3 and the first cam surface 25 of the second cam portion 35 of the second link member 2 are in contact with each other, namely, in the first contact state where the urging force of the plate springs 20 and 31 act in the direction to make the first cam surfaces 25 contact with each other. Thus, as shown in FIG. 2, the second shaft 22 of the first link member 3 is positioned at a right side within the recess 17A of the corresponding engagement member 17, the fourth shaft 33 of the second link member 4 is positioned at a left side within the recess 17A of the corresponding engagement member 17, thereby securely holding the key top in the non-pressed position. In the first contact state, since the urging force of the plate springs 20 and 31 act in the direction to bring the first cam surfaces 25 into contact with each other, the key top 2 held in the non-pressed position would not move in a horizontal direction. This makes it possible to prevent rattles of the key top 2.

Figure 8:
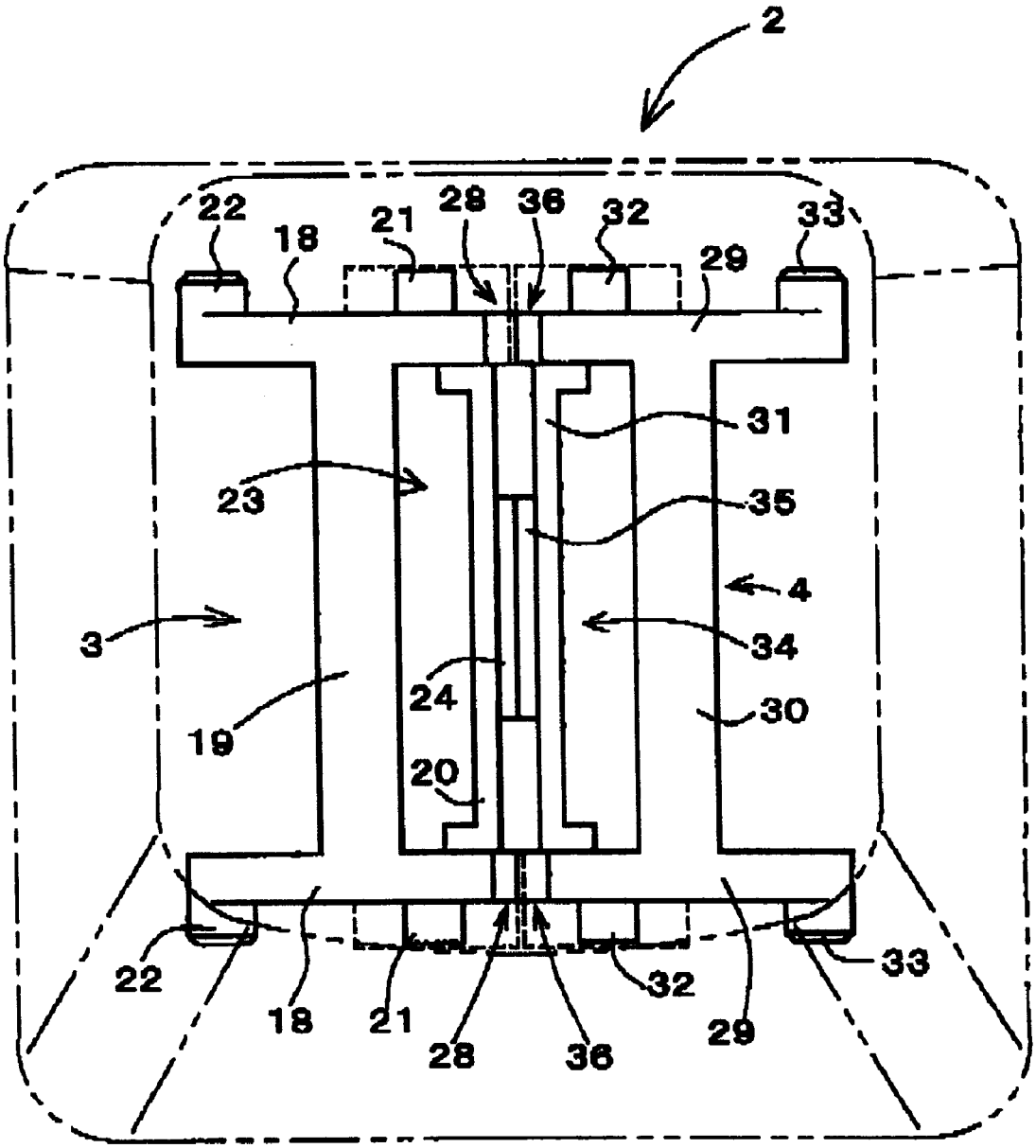
FIG. 8 is a top view of the first and second link members assembled with each other, which are positioned in the non-pressed state of the key top.

FIG. 8 is a top view of the first and second link members is 3 and 4 when the key top 2 is in the non-pressed state, the first and second link members being looked through the key top 2 illustrated with a phantom line. In FIG. 8, the key top 2 is in the first contact state where the first cam portion 24 of the first link member 3 and the second cam portion 35 of the second link member 4 are in contact with each other. The plate springs 20 and 31 of the first and second link members 3 and 4 urge the first and second cam portions 24 and 35 in a direction to come into contact with each other, but the springs 20 and 31 are not bent. If preloading is required, each of the plate springs 20 and 31 is bent in correspondence with the preloading amount.

Figure 9:
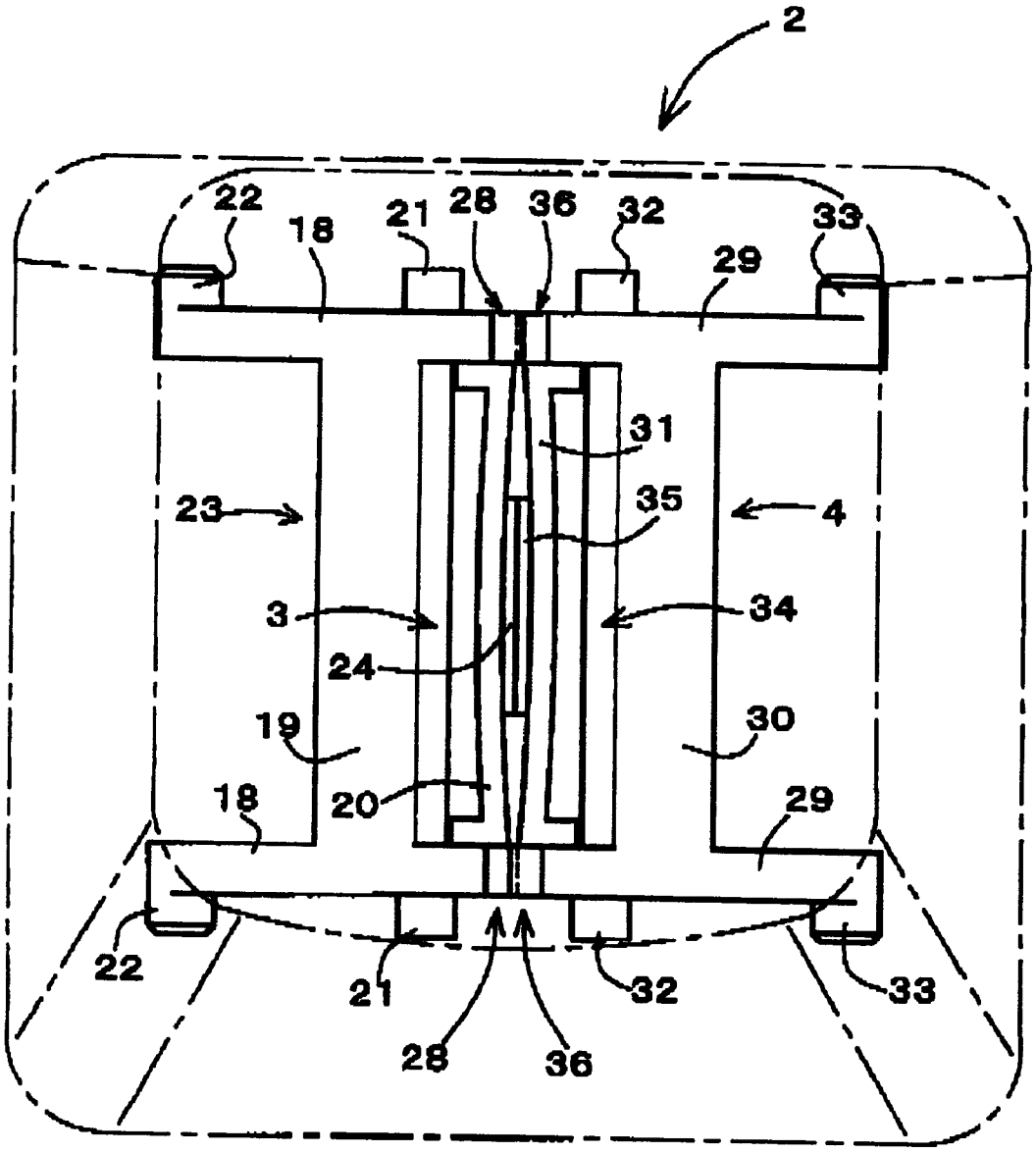
FIG. 9 is a top view of the first and second link members in a state where the first and second link members are in contact, with each other through cam apexes.

With the start of pressing of the key top 2, the first shaft 21 of the first link member 3 is rotated clockwise in the recess 8A of the engagement portion 8 in response to down movement of the key top 2, while the third shaft 32 of the second link member 4 is rotated counterclockwise in the recess 9A of the engagement portion 9. Simultaneously, the second shaft 22 of the first link member 3 is slid leftwards in the recess 17A of the corresponding engagement member 17, while the fourth shaft 33 of the second link member 4 is slid rightwards in the recess 17A of the corresponding engagement member 17. The first cam surfaces 25 of the first and second cam portions 24 and 35 are gradually separated, and then the first and second cam portions 24 and 35 are kept in contact with each other through the cam apexes 27. This state is shown in FIG. 7E. In this state, as shown in a top view in FIG. 9, the plate springs 20 and 31 are bent maximally, when the urging force of each of the plate springs 20 and 31 exerted on the first and second cam portions 24 and 25 respectively reaches the maximum. The pressing load on the key top 2 becomes the maximum, accordingly.

It is to be noted that the cam apex 27 of the first cam portion 24 has the projection 27A, while the cam apex 27 of the second cam portion 35 has the groove 27B, the projection 27A being fitted in the groove 27B. When the cam apexes 27 of the first and second cam portions 24 and 35 are in engagement with each other, therefore, the cam apexes 27 would not be dislocated from each other, thus making it possible to completely synchronize the first and second cam portions 24 and 35.

When the key top 2 is further pressed down, the second cam surfaces 26 of the first and second cam portions 24 and 35 gradually approach each other. This state is shown in FIG. 7C. A degree of bending of the plate springs 20 and 31 is smaller than the case shown in FIG. 7B and FIG. 9. The urging force of each of the plate springs 20 and 31 exerted on the first and second cam portions 24 and 35 is gradually reduced, so that the pressing load on the key top 2 is also reduced.

Prior to the contact between the second cam surfaces 26 of the first and second can portions 24 and 35, the elastic resinous piece 24A formed in the lower end of the first cam portion 24 and the elastic resinous piece 35A formed in the lower end of the second cam portion 35 press the upper film sheet 14 of the membrane switch sheet 7. Thus, the moavable electrode pattern 13 provided on the lower surface of the upper film sheet 14 is made into contact with the fixed electrode pattern 10 of the lower film sheet 12 through the switching hole 15 of the film spacer 16, thereby conducting a switching operation. At substantially the same time or after the switching operation, the second cam surfaces 26 are made into contact with each other. In this manner, due to the contact between the second cam surfaces 26 made upon or after the switching operation, the pressing motion of each of the resinous pieces 24A and 35A can be stabilized to prevent chattering and the like.

Figure 7B:
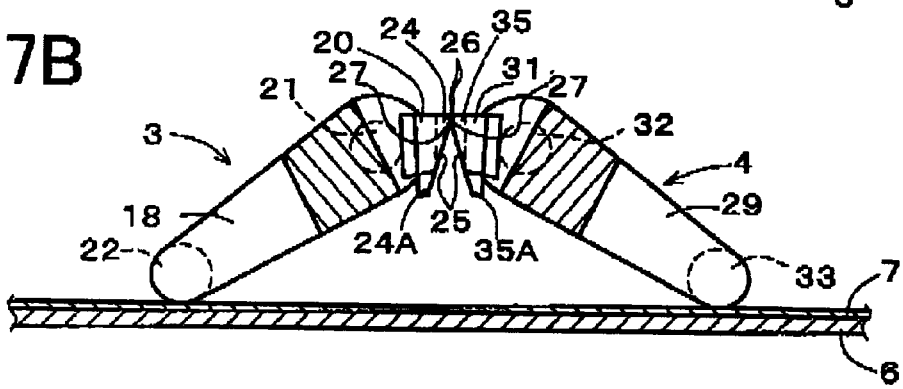
Figure 7C:
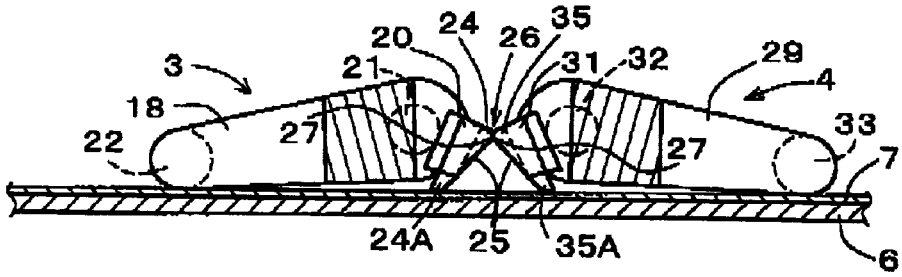
Figure 7D:
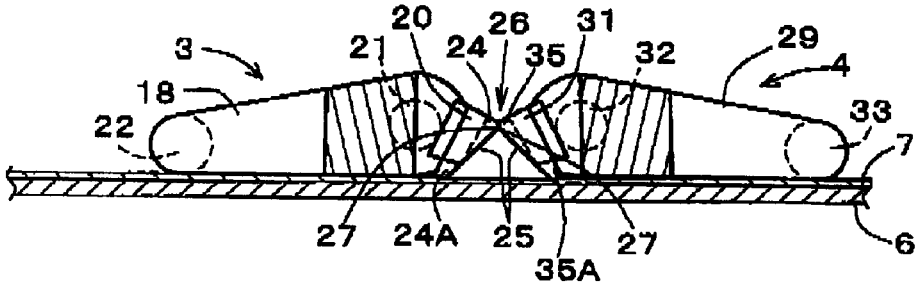

FIG. 7D shows the state where the second cam surfaces 26 are in contact with each other. In this state, the bending degree of the plate springs 20 and 31 is further smaller than the case shown in FIG. 7C. Accordingly, the urging force of the plate springs 20 and 31 exerted on the first and second cam portion 24 and 35 is further reduced, resulting in a further reduced pressing load on the key top 2.

Figure 10:
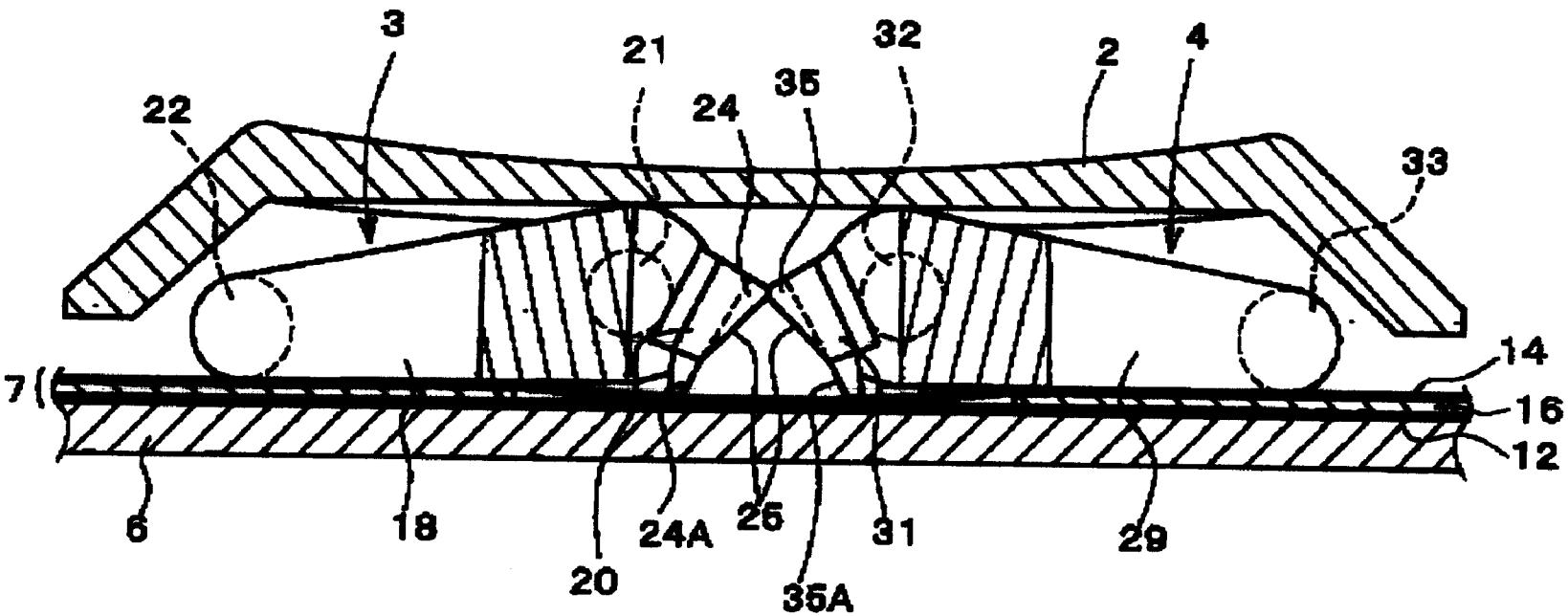
FIG. 10 is a schematic sectional side view of the key switch device being in a switching position.

As mentioned above, in the state where the second cam surfaces 26 of the first and second cam portions 24 and 35 are in contact with each other, the elastic resinous piece 24A formed in the lower end of the first cam portion 24 and the elastic resinous piece 35A formed in the lower end of the second cam portion 35 press the upper film sheet 14 of the membrane switch sheet 7 so that the movable electrode pattern 13 formed on the lower surface of the upper film sheet 14 is brought into contact with the fixed electrode pattern 10 of the lower film sheet 12 through the switching hole 15 of the film spacer 16. The state of the switching operation performed as above is shown in FIG. 10. FIG. 10 is a schematic sectional side view of the key switch device 1 in the switching operation. It is seen therein that the elastic resinous pieces 24A and 35A press the upper film sheet 14 to come into contact with the lower film sheet 12.

It is preferable that the resinous pieces 24A and 35A contact with the upper film sheet 14 at the same time to press it. If one of them, for example, the resinous piece 24A first contacts the upper film sheet 14a the other resinous piece 25A subsequently, or almost simultaneously, contacts the upper film sheet 14. Even when vibration and the like is generated in the upper film sheet 14 due to the contact of the resinous piece 24A with the upper film sheet 14, the vibration of the upper film sheet 14 can be removed by the contact of the other resinous piece 35A with the upper film sheet 14. Therefore, the chattering which may be generated at the time of the switching operation can be surely prevented.

Each of the elastic resinous pieces 24A and 35A is elastically deformed from the state shown in FIG. 7D when the key top 2 is further pressed down. The resinous pieces 24A and 35A then absorb the moving amount of the key top 2, thus enabling the so-called overtravel of the key top 2.

Upon release of the pressure of the key top 2 after the switching operation as mentioned above, the key top 2 is moved in reverse order due to the urging force of the plate spring 20 of the first link member 3 and the plate spring 31 of the second link member 4, then returns to the non-pressed position shown in FIG. 7A.

Figure 11:
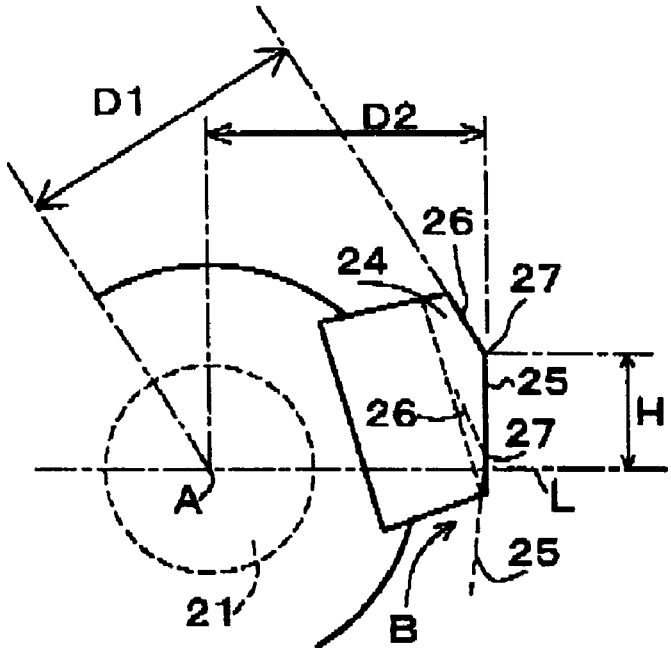
FIG. 11 is a schematic explanatory view of conditions of formation of the first and second cam portions.

To return the key top 2 to the original non-pressed position by the urging force of the plate springs 20 and 31, it is essential that the contacting point of the cam apexes 27 of the first and second cam portions 24 and 35 is positioned above an imaginary line connecting the center of the first shaft 21 of the fist link member 3 and the center of the third shaft 32 of the second link member 4. This condition is explained with reference to FIG. 11. FIG. 11 is a schematic explanatory view of conditions of formation of the first and second cam portions 24 and 35.

FIG. 11 shows the imaginary line L passing the center A of the first shaft 21 of the first link member 3 and the center (not shown) of the third shaft 32 of the second link member 41 and the outline B of the first cam portion 24 positioned at a position for the switching operation. In this state, the cam apex 27 of the first cam portion 24 indicated by the outline B (and also the cam apex 27 of the second cam portion 35) has to exist above than the line L. With such the configuration, the turning moment produced by the urging force of the plate springs 20 and 31 acts upwards with respect to the first can portion 24 indicated by the outline B. By only the urging force of the plate springs 20 and 31, thus, the key top 2 can be moved upwards without use of a rubber spring and other urging mechanisms.

Similarly, in order to produce the turning moment of rotating the first and second link members 3 and 4 upwards based on the urging force of the plate springs, 20 and 31 at the time when the switching operation is performed, it is necessary that the distance D1 between the center A of the first shaft 21 (or the third shaft 32) and the second cam surface 26 is set to be larger than the distance D2 between the center of the first shaft 21 (or the third shaft 32) and the first cam surface 25.

The distance H between the line L and the can apex 27 (i.e., the height of the cat apex 27 from the line L) is a factor to determine the load (peak load) to be exerted on the key top 2 placed in the state shown in FIG. 7B.

Figure 12:
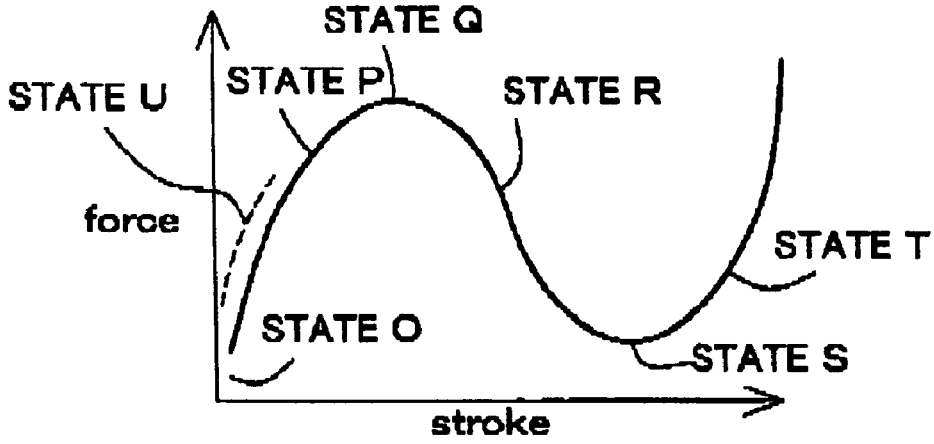
FIG. 12 is a graph of the stroke-load curve of the key top pressed down.

A series of movements mentioned above is explained below with reference to a stroke-load curve of FIG. 12. In FIG. 12, the lateral axis indicates a stroke of the key top 2 and the vertical axis indicates a pressing load (or force) exerted on the key top 2.

At first, in the state O, the key top 2 is not pressed and is held in the non-pressed state by means of the urging force of the plate springs 20 and 31. At this time, the first cam surfaces 25 of the first and second cam portions 24 and 35 are in contact with each other, where the plate springs 20 and 31 are not bent. It is to be noted that if preloading is needed, the plate springs are bent in correspondence with the preloading amount (the state U). The state O corresponds to the states shown in FIGS. 7A and 8.

As the key top 2 is pressed down, the first cam surfaces 25 of the first and second cam portions 24 and 35 are gradually separated. This state corresponds to the state P. The plate springs 20 and 31 are bent little by little, thereby increasing the pressing load. The state P is between the states shown in FIGS. 7A and 7D.

When the key top 2 is further pressed down, the first and second cam portions 24 and 35 are brought into contact with each other through the cam apexes 27. This state corresponds to the state Q. At this time, the plate springs 20 and 31 are bent maximally, increasing the pressing load to the maximum (i.e., the peak load). The state Q corresponds to the sates shown in FIGS. 7B and 9.

When the key top 2 is furthermore pressed, the second cam surfaces 26 of the first and second cam portions 24 and 35 gradually come close to each other. This state corresponds to the state R. At this time, the degree of bending of the plate springs 20 and 31 is gradually reduced from the bending degree in the state P, thereby reducing the pressing load. The state R corresponds to the state shown in FIG. 7C.

Further pressure of the key top 2 brings the second cam surfaces 26 into contact with each other. This state corresponds to the state S. At this time, the bending degree of the plate springs 20 and 31 is reduced to the minimum at the instant when the second cam surfaces 26 are made into contact with each other, thus reducing the pressing load to the minimum. The state S corresponds to the state shown in FIGS. 7D and 10. The elastic resinous piece 24A of the first cam portion 24 and the elastic resinous piece 35A of the second cam portion 35 perform the switching operation on the membrane switch sheet 7.

When the key top 2 is further pressed down after the switching operation mentioned above, the resinous pieces 24A and 35A are elastically deformed to enable overtravel. This state corresponds to the state T. At this time, the resinous pieces 24A and 35A elastically deformed press the membrane switch sheet 7, and the pressing load is increased again.

As described above in detail, the key switch device 1 in the first embodiment is configured such that each of the first and second cam portions 24 and 35 is provided with the first cam surface 25, the cam apex 27, and the second cam surface 26, and the plate spring 20 is integrally formed with the first cam portion 24 and the plate spring 31 is integrally formed with the second cam portion 25. In the non-pressed state of the key top 2, the urging force of the plate springs 20 and 31 causes the first cam surfaces 25 of the first and second cam portions 24 and 35 to come into contact with each other, thereby to securely hold the key top 2 in the non-pressed position. In the pressed state, the urging force of the plate springs 20 and 31 retains the upward turning moment of the first and second link members 3 and 4, while the elastic resinous pieces 24A and 35A perform a switching operation on the membrane sheet 7 as the second cam surfaces 26 of the first and second cam portions 24 and 35 are in contact with each other. Accordingly, with the above-mentioned simple structures of the first and second cam portions 24 and 35, each having the first and second can surfaces 25 and 26 and the cam apex 27, and the plate springs 20 and 31, the key top 2 can be held in the non-pressed position and returned to the non-pressed position after the switching operation. The key switch device 1 configured as above, using no rubber spring and complicated urging mechanism, can achieve the reduction of cost.

By the urging force of the plate springs 20 and 31, the first cam surfaces 25 of the first and second cam portions 24 and 35 are made into contact with each other, so that the key top 2 is held in the non-pressed position. Similarly, the second cam surfaces 26 are made into contact with each other, so that the key top 2 is retained in the pressed position. Thus, the key top 2 can be securely held and retained in the non-pressed position and the pressed position respectively.

Upon pressure of the key top 2, the contact between the first and second cam portions 24 and 35 passes the cam apexes 27 each farmed at the boundary between the first and second cam surfaces 25 and 26 to shift from the first contact state to the second contact state, when the key top 2 provides a click. This makes it possible for an operator to have a clear key operating sense. Furthermore, the first and second cam portions 24 and 35 are always in contact with each other by means of the plate springs 20 and 31 while shifting a contact position in association with the vertical movement of the key top 2. Changing the shapes of the first and second cam portions 24 and 35 as required, therefore, the click sense to be generated in the key operation can be flexibly designed.

Since the angle defined by the first and second cam surfaces 25 and 26 with the cam apex 27 in the center is set to an obtuse angle, the first and second cam portions 24 and 35 can be smoothly moved from the first contact state, passing the cam apex 27, to the second contact state. Thus, this can achieve a key operation with an appropriate, precise click sense. The angle defined by the first cam surface 25, the apex 27, and the second cam surface 26 can be freely determined in view of the urging force of the plate springs 20 and 31, and others. Thus, the click sense to be generated in the key operation can be flexibly designed.

It is to be noted that, if the angle defined by the first cam surface 25, the apex 27, and the second cam surface 26 is an acute angle, the urging force of the plate springs to be exerted on the key top 2 increases, thereby increasing the pressing load more than necessary and the impact in passing the cam apex 27 when the cam portions are moved from the first contact state to the second contact state. The key operability is thus deteriorated.

The distance D1 between the center A of the first shaft 21 of the first link member 3 or the third shaft 32 of the second link member 4 and the second cam surface 26 is set to be larger than the distance D2 between the center A of the first shaft 21 or the third shaft 32 and the first cam surface 25. If this condition is fulfilled, the turning moment of the first and second link members 3 and 4 acts upward even when the key top 2 is depressed to the final pressed position. The key top 2 thus can be moved upwards and returned to the original non-pressed position by the urging force of the plate springs 20 and 31.

The membrane switch sheet 7 arranged on the support plate 6 provides the switching section, so that easy handling of the switching section can be realized. In addition, assembling of a plurality of the key switch devices 1 to construct the keyboard can be facilitated.

In the above embodiment, the chip-shaped engagement member 17 adhered on the upper surface of the upper film sheet 14 of the membrane switch sheet 7 is used for slidably engaging the second shaft 22 of the first link member 3 and the fourth shaft 33 of the second link member 4. As compared with the case where the support plate 6 is directly formed with engagement portions by press working, the key switch device 1 can be manufactured without expensive press die, thus accomplishing extreme reduction in manufacturing cost.

The rigidity of the plate springs 20, 31 can be properly adjusted by changing the width of the plate springs. This makes it possible to easily adjust the peak load on the key top 2 to be generated in the state where the first and second cam portions 24 and 35 are in contact with each other only through the cam apexes 27. By proper change of the distance H between the cam apex 27 and the imaginary line L passing the center of the first shaft 21 of the first link member 3 and the center of the third shaft 32 of the second link member 4, i.e., the height of the cam apex 27 from the line L, the timing that the peak load appears can be freely adjusted.

Next, a key switch device in a second embodiment, provided in a keyboard 105 of the notebook-size personal computer mentioned above will be described with reference to FIGS. 13–16. The key switch device in the second embodiment is substantially identical in structure to that in the first embodiment. A different point from the first embodiment is in the use of an engagement member for rotatably engaging one link member, e.g., the fourth shaft 33 of the second link member 4, instead of the engagement member 17 adhered on the upper film sheet 14 of the membrane switch sheet 7 arranged on the support plate 6 in the first embodiment for slidably engaging the second shaft 22 of the first link member 3 and the fourth shaft 33 of the second link member 4. The other elements are the same as in the first embodiment. Therefore, like elements are given like reference numbers and the detailed explanation thereof is omitted in the second embodiment. Only the feature in the second embodiment is explained below.

Figure 13:
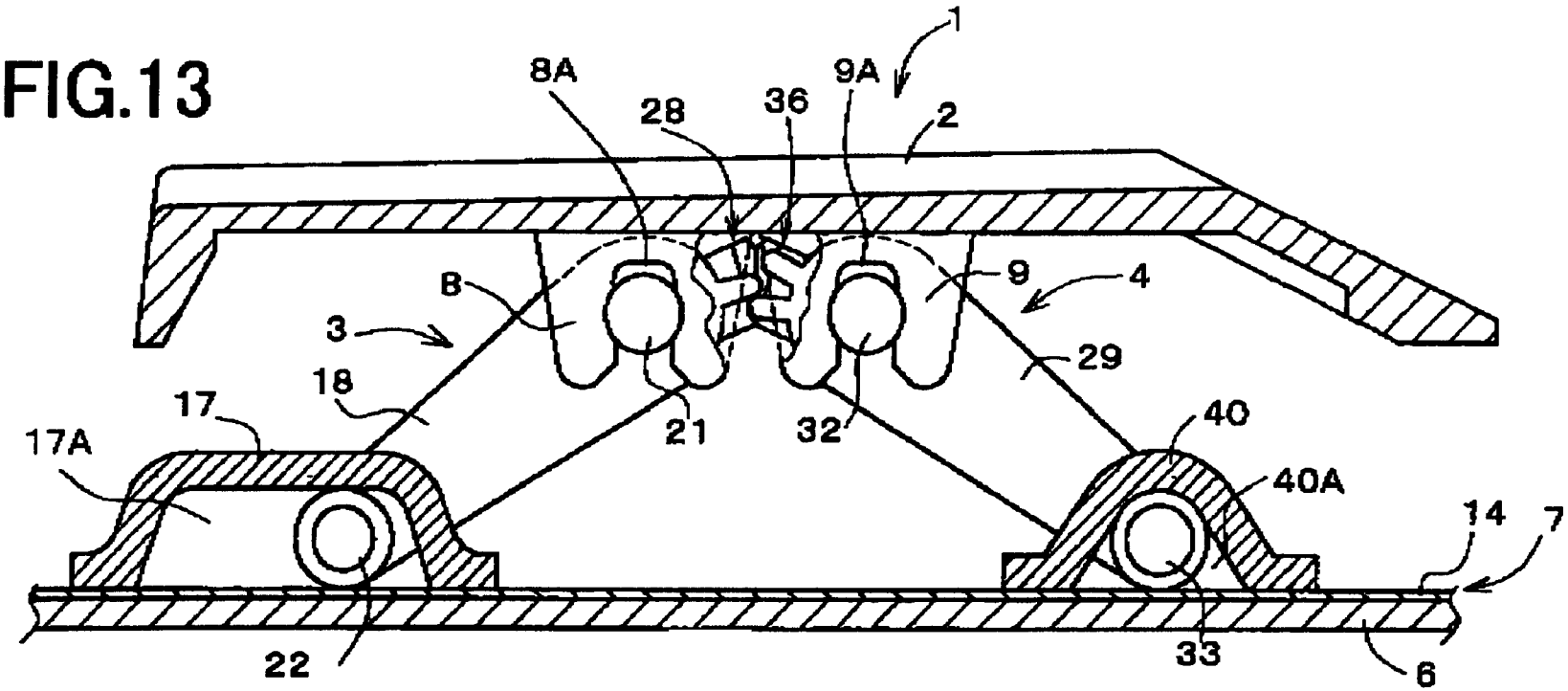
FIG. 13 is a schematic side view of a key switch device in a second embodiment according to the present invention, a key top of which is positioned in a non-pressed position.
Figure 14:
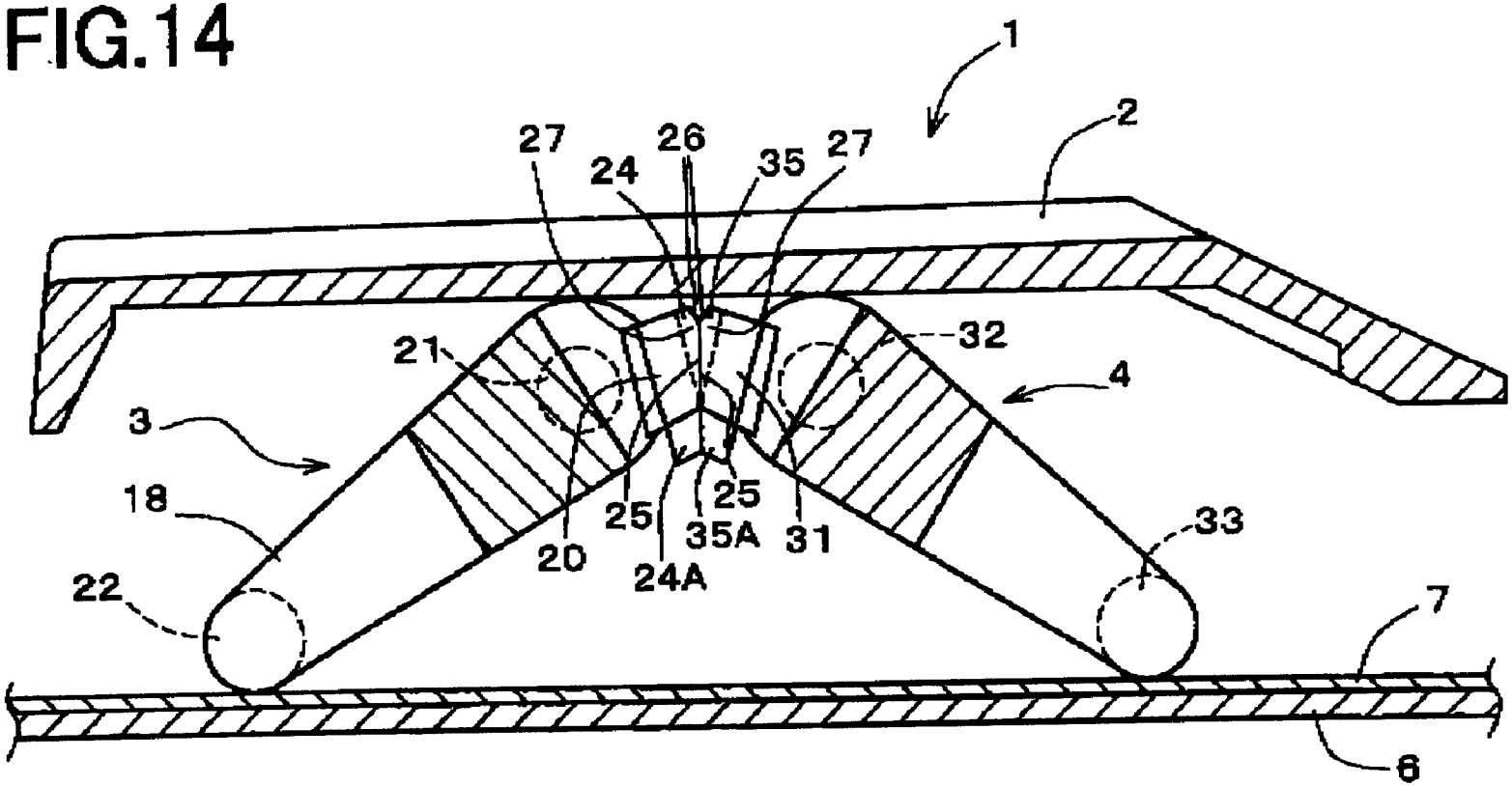
FIG. 14 is a schematic sectional side view of the key switch device with the key top positioned in the non-pressed position.
Figure 15:
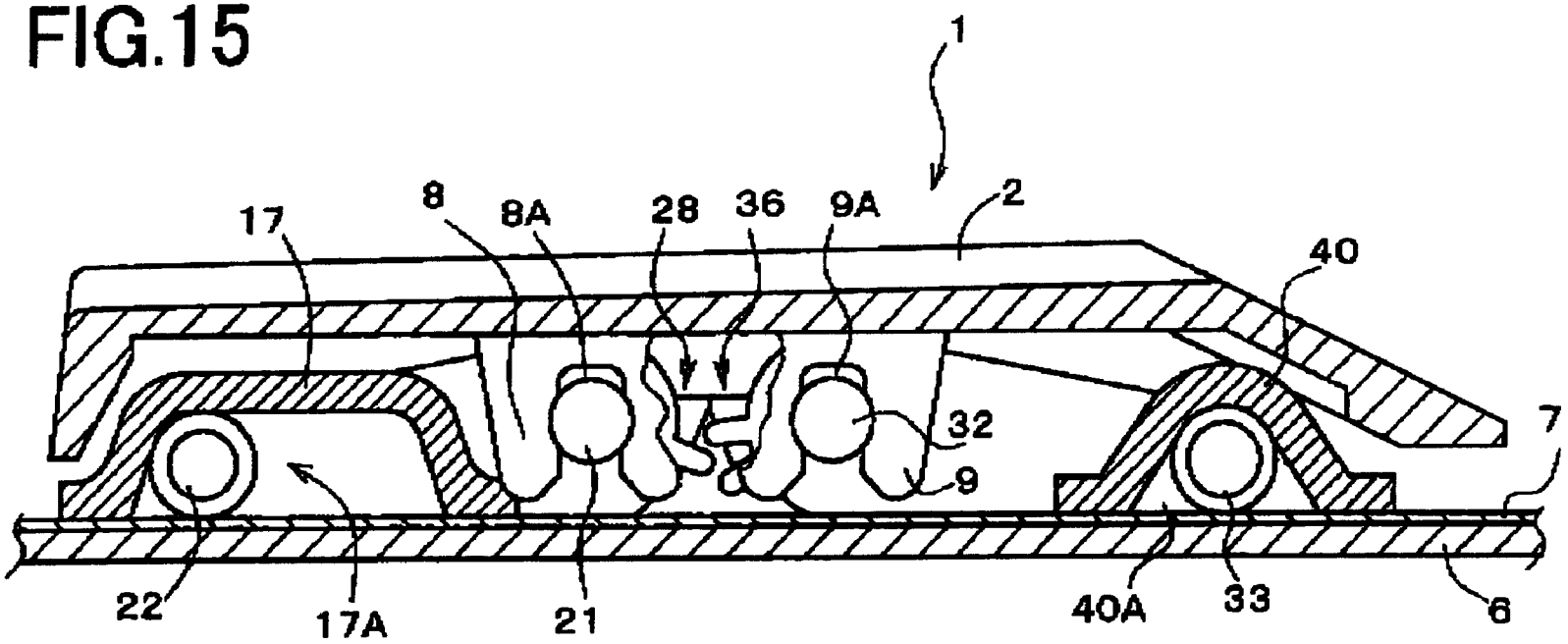
FIG. 15 is a schematic side view of the key switch device with the key top positioned in a pressed position.
Figure 16:
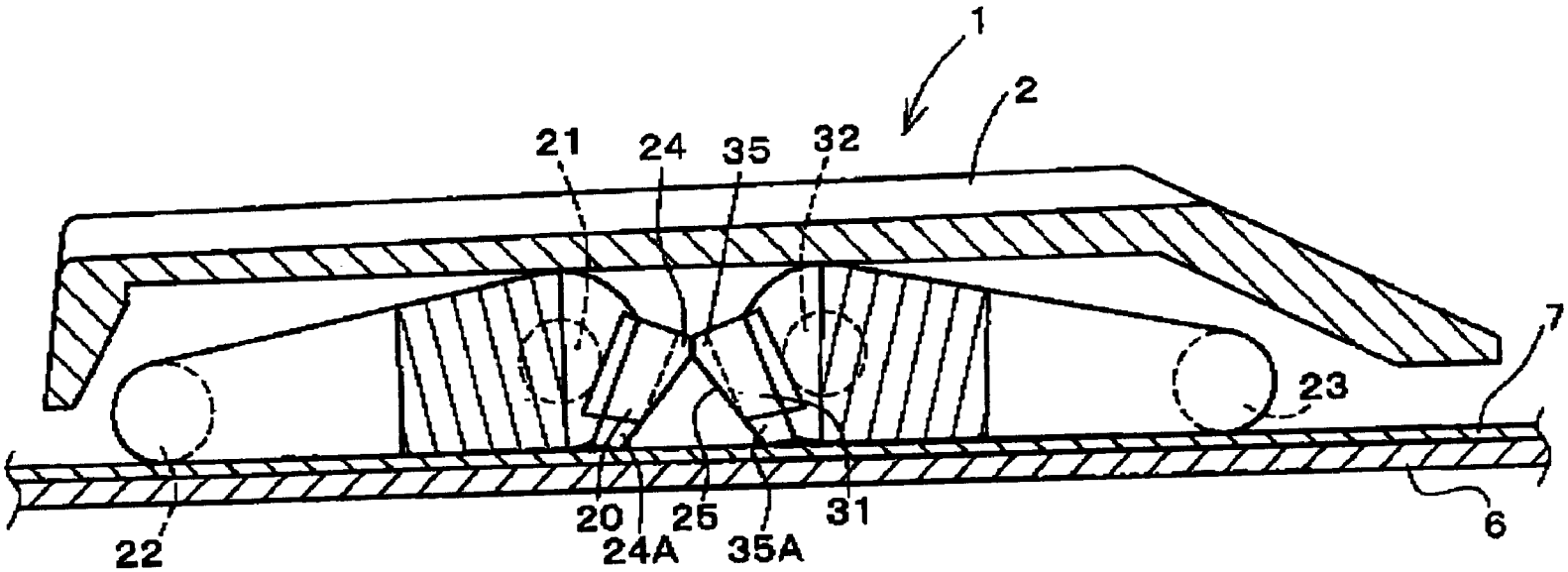
FIG. 16 is a schematic sectional side view of the key switch device with the key top positioned in the pressed position.

FIG. 13 is a schematic side view of a key switch device in the second embodiment, a key top of which is positioned in a non-pressed position (an "up" position); FIG. 14 is a schematic sectional side view of the key switch device with the key top positioned in the non-pressed position; FIG. 15 is a schematic side view of the key switch device with the key top positioned in a pressed position (a "downs" position); and FIG. 16 is a schematic sectional side view of the key switch device with the key top positioned in the pressed position.

In FIGS. 13 and 14, an engagement member 17 having a recess 17A for slidably engaging the second shaft 22 of the first link member 3 is adhered with adhesion on the upper surface of the upper film sheet 14 of the membrane switch sheet 7. Similarly, an engagement member 40 having a recess 40A for rotatably engaging the fourth shaft 33 of the second link member 4 is adhered on the same surface of the upper film sheet 14.

In the key switch device 1, upon pressure of the key top 2, the first shaft 21 of the first link member 3 is rotated clockwise in the recess 8A of the engagement portion 8, while the second shaft 22 is slid leftwards within the recess 17A of the engagement member 17. The third shaft 32 of the second link member 4 is rotated counterclockwise in the recess 9A of the engagement portion 9, while the fourth shaft 33 is rotated counterclockwise in the recess 40A of the engagement member 40. At this time, the first cam portion 24 of the first link member 3 and the second cam portion 35 of the second link member 4 move obliquely down (in an obliquely left direction in FIGS. 13 and 14), not vertically down, with respect to the membrane switch sheet 7. In association therewith, the movable contact pattern 13 of the upper film sheet 14 forming the membrane switch sheet 7, the switching hole 15 of the film spacer 16, and the fixed electrode pattern 10 of the lower film sheet 12 are formed at each position dislocated in an oblique left direction with respect to the first and second cam portions 24 and 35 positioned in the non-pressed position of the key top 2.

The structures and functions of the first and second cam portions 24 and 35 of the first and second link members 3 and 4 are the same as in the key switch device 1 in the first embodiment. The detailed explanation thereof is omitted in the present embodiment.

The state where the key top 2 is pressed to perform a switching operation is shown in FIGS. 15 and 16. The switching operation is the same as in the first embodiment.

It is sure that the key switch device 1 in the second embodiment can provide the same effect as that in the first embodiment.

In the second embodiment, the first shaft 21 of the first link member 3 and the third shaft 32 of the second link member 4 are rotatably engaged in the engagement portions 8 and 9 of the key top 2, respectively. The second shaft 22 of the first link member 3 is slidably engaged in the engagement member 17 provided on the membrane switch sheet 7, while the fourth shaft 33 of the second link member 4 is rotatably engaged in the engagement member 40 provided on the membrane switch sheet 7. Accordingly, the key top 2 is moved obliquely down with respect to the support plate 6. Considering the characteristics that the fingers of the operator are not all equal, the above stricture is desirable in a key operation from ergonomics standpoint.

Next, a key switch device in a third embodiment, provided in a keyboard 105 of the notebook-size personal computer mentioned above will be described with reference to FIGS. 17 and 18.

Figure 17:
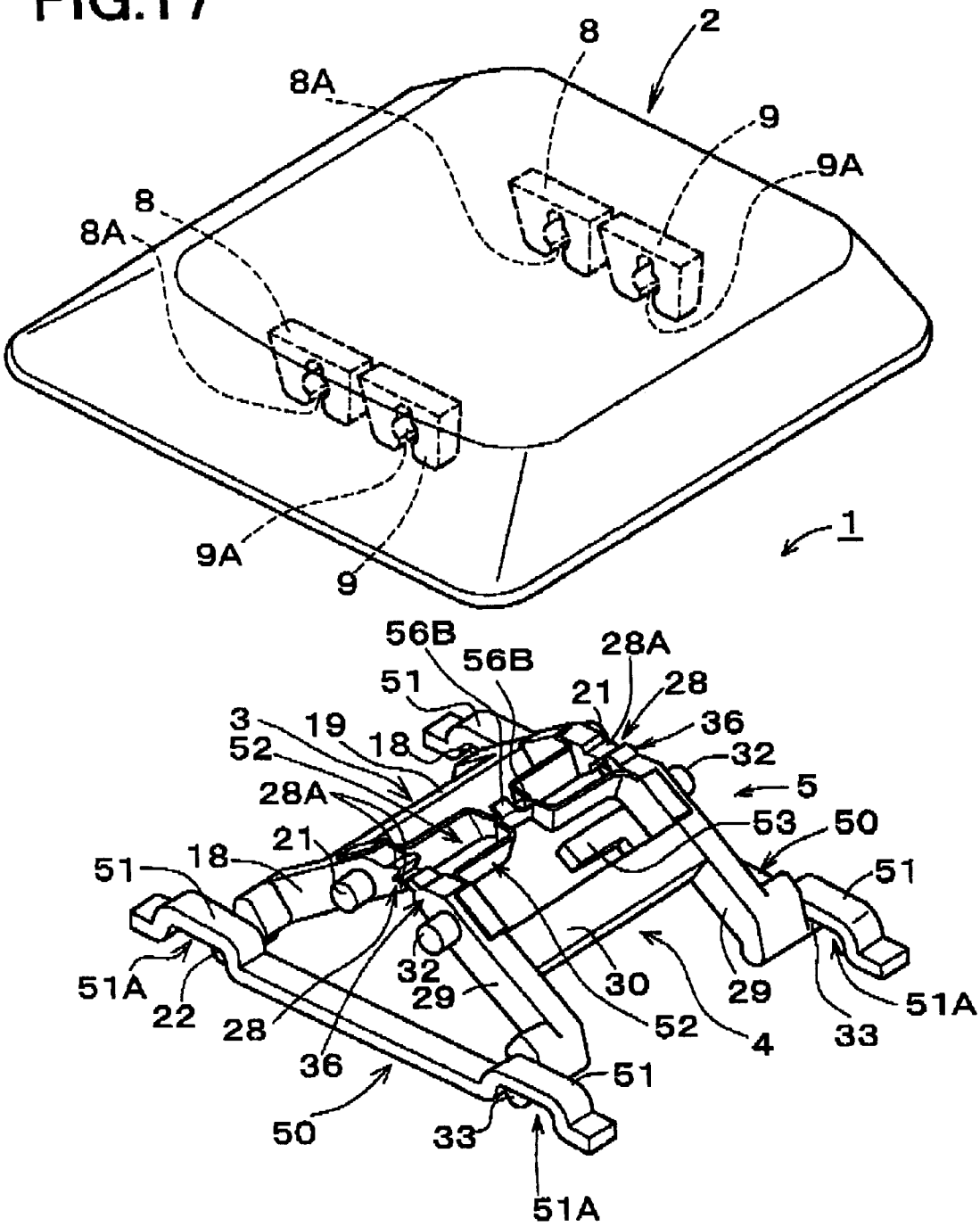
FIG. 17 is a perspective exploded view of a key top and a guide member of a key switch device in a third embodiment according to the present invention.
Figure 18:
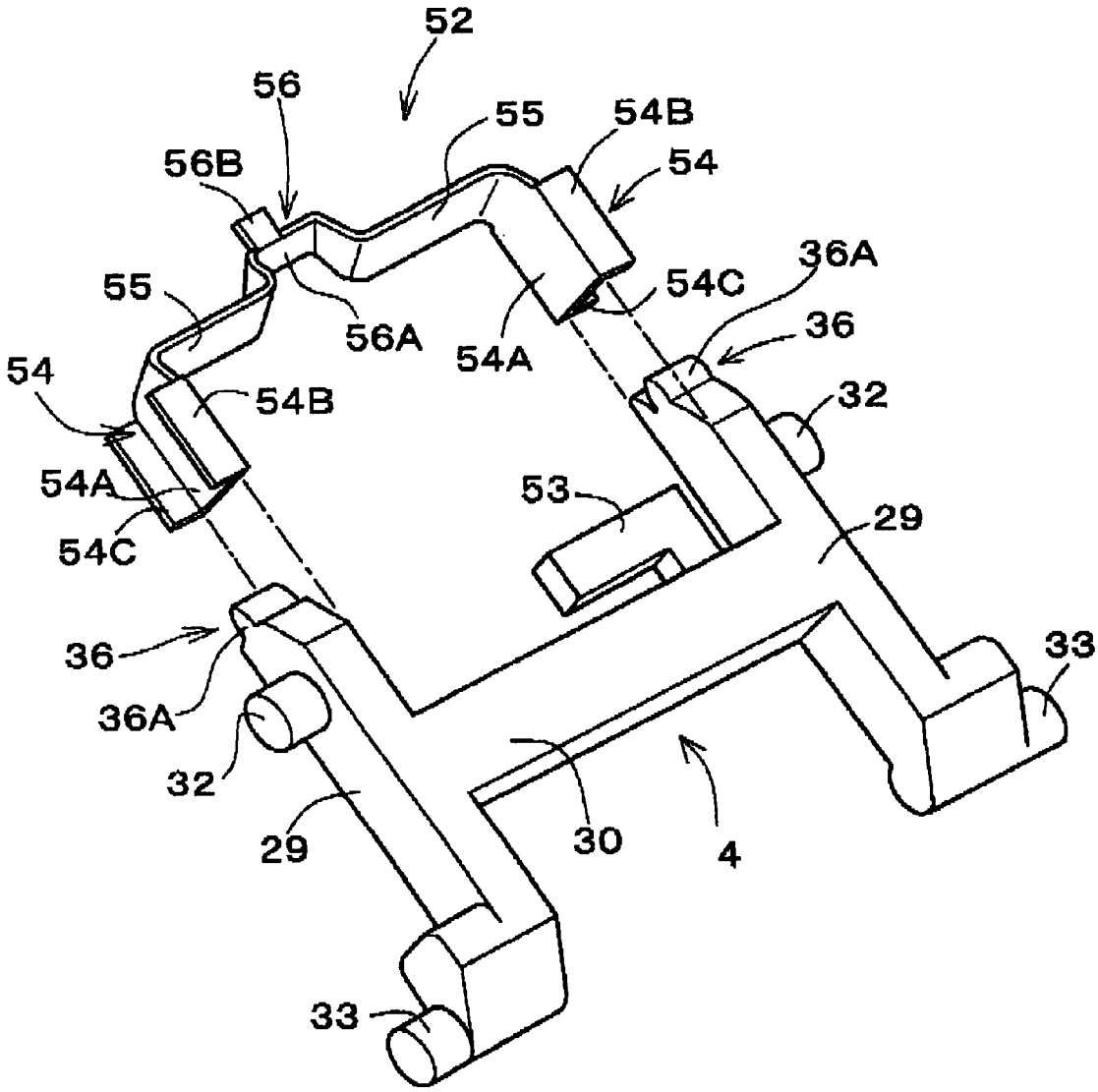
FIG. 18 is a schematic explanatory view of a link member with a cam member detachably provided thereto.

FIG. 17 is a perspective exploded view of a key top and a guide member of the key switch device in the third embodiment. FIG. 18 is a schematic explanatory view of a link member with a cam member detachably provided thereto. The key switch device in the third embodiment is substantially identical in structure to that in the first embodiment. Differences from the first embodiment are in a first point that each of a first and second link members configuring a guide member is provided with a plate spring that is provided with a cam portion and formed of a metallic material, not formed integrally with the link members, and the cam members are detachably provided to the first and second link members; a second point that an elastic resinous piece used for a switching operation on the membrane switch sheet is formed into one body with a joint portion of one of the link members; and a third point that an engagement member for slidably engaging the second shaft of the first link member and an engagement member for slidably engaging the fourth shaft of the second link member are made into one body and adhered on the surface of the upper film sheet of the membrane switch sheet. The other elements are the same as in the first embodiment. Therefore, like elements are given like reference numbers and the detailed explanation thereof is omitted in the third embodiment. Only the feature in the third embodiment is explained below.

In FIGS. 17 and 18, the first link member 3 is structured of a pair of plate members 18, 18 and a joint portion 19 coupling the plate members 18, 18, which are made of polyacetal resin and the like into one piece. The first shaft 21 is provided in the plate member 18 so as to extend outward at a position near one end side of the plate member 18 (i.e., in an upper end side in FIG. 17). The second shaft 22 is provided in the plate member 18 so as to extend outward at a position near another end side (i.e., in a lower end side in FIG. 17). The first shaft 21 is rotatably engaged in the recess 8A of the engagement portion 8 of the key top 2. The second shaft 22 is slidably engaged in a recess 51A of an engagement portion 51 of an engagement member 50 adhered on the surface of the upper film sheet 14 of the membrane switch sheet 7.

The engagement member 50 is formed having a length corresponding to a key switch device, and provided with two engagement portions 51 formed into one body and arranged in the end sides. Each of the engagement portions 51 has a recess 51A. The second shaft 22 of the first link member 3 is slidably engaged within the recess 51A of one engagement portion 51, while the fourth shaft 33 of the second link member 4 is slidably engaged within the recess 51A of the other engagement portion 51. As shown in FIG. 17, the two engagement members 50 are arranged in parallel in a predetermined area of the key switch device 1, and slidably engage the second shaft 22 and the fourth shaft 33 at both sides of the first and second link members 3 and 4. The joint portion 19 is to couple the plate members 18 at a distance therebetween.

Each plate member 18 is provided with a gear portion 28 arranged in a more end side than the first shaft 21 (i.e., in a right side of the plate member 18 in FIG. 17). The gear portion 28 includes one tooth or two teeth 28A. In FIG. 17, the left plate member 18 has the gear portion 28 of two teeth 28A and the right plate member 18 has the gear portion 28 of one tooth 28A. The gear portion 28, as will be mentioned later, engages with a gear portion 36 formed in the end of the plate member 29 of the second link member 4 to function for simultaneously operating the first and second link members 3 and 4 in association with the vertical movement of the key top 2.

An elastic cam member 52 which is a thin plate made of metal such as stainless steel and the like is detachably mounted on the plate members 18 above the joint portion 19. The elastic cam member 52 attached to the plate members 18 of the first link member 3 has the same structure as an elastic cam member 52 attached to the plate members 29 of the second link member 4 mentioned later. The structure thereof will be described later along with the structure of the second link member 4.

Next, the structure of the second link member 4 is described with reference to FIGS. 17 and 18. The second link member 4 is structured of a pair of plate members 29, 29 and a joint portion 30 joining the plate members 29, 29, which are made of polyacetal resin and the like into one piece. The third shaft 32 is provided in the plate member 29 so as to extend outward at a position near one end side of the plate member 29 (i.e., in an upper end side in FIG. 17). The fourth shaft 33 is provided in the plate member 29 so as to extend outward at a position near another end side (i.e., in a lower end side in FIG. 17). The third shaft 32 is rotatably engaged in the recess 9A of the engagement portion 9 of the key top 2. The fourth shaft 33 is slidably engaged in the recess 51A of the engagement portion 51 of the engagement member 50 adhered on the upper surface of the upper film sheet 14 of the membrane switch sheet 7. The joint portion 30 is to couple the plate members 29, 29 at a distance therebetween.

As shown in FIG. 18, an elastic resinous part 53 is formed into one body with the joint portion 30, the part 53 being bent upper-leftwards from the right of the joint portion 30 in figures. A pressing projection (not shown) is also provided on the lower surface of the elastic resinous part 53 to serve to conduct a switching operation with respect to the membrane switch sheet 7 upon depression of the key top 2. Like the first link member 3, an elastic cam member 52 which is a thin plate made of metal such as stainless steel and the like is detachably mounted on the plate members 29 above the joint portion 30.

The structure of the elastic cam member 52 is explained below with reference to FIGS. 17 and 18. This elastic cam member 52 is a thin elastic plate made of stainless steel and the like, which is constructed of a pair of attachment portions 54 forming both end sides of the cam member 52, a plate spring portion 55 connected to the attachment portions 54, and a cam portion 56 formed projecting in the plate spring portion 55, all of which are formed into one body.

Each of the attachment portions 54 has a base part 54A, and an upper part 54B and a lower part 54C bent from the base part 54A to substantially have an angular U-shaped cross-section. The distance between the upper and lower parts 54B and 54C is designed to be almost equal to the thickness of the plate member 29. The attachment portions 54 are fitted on the plate members 29 until the lower ends of the attachment portions 54 come into contact with the upper plane of the joint portion 30. The elastic cam member 52 is thus attached to the second link member 4 with the attachment portions 546

The plate spring portion 55 is bent continuously from the base parts 54A and formed into one body therewith to produce spring elasticity. The cam portion 56 is rectangularly projected outwards in the substantial center of the plate spring portion 55. This cam portion 56 is constructed of a cam surface 56A configuring the first cam surface and an engagement piece 56B formed upwards at a predetermined inclination angle on the upper edge of the cam surface 56A.

The engagement piece 56B is arranged at a slightly displaced position (leftward in FIG. 18) from the center of the cam surface 56A.

Explanation is made on the engagement relationship between the first and second link members 3 and 4, to each of which the elastic cam member 52 is attached, referring to FIG. 17. In FIG. 17, when the first and second link members 3 and 4 are assembled to configure the guide member 5, the cam surfaces 56A of the elastic cam members 52 respectively attached to the plate members 18 of the first link member 3 and the plate members 29 of the second link members 4 are in contact with each other by the elastic urging force of the plate spring portions 55. This state is regarded as a first contact state. In this first contact state the key top 2 is securely held in the non-pressed state. Since the engagement piece 56B of the elastic cam member 52 is slightly displaced from the center of the cam surface 56A, the engagement piece 56B of the elastic cam member 56 attached to the first link member 3 and the engagement piece 56B of the elastic cam member 56 attached to the second link member 4 are engaged with the upper edges of the opposite cam surfaces 56A respectively so that the pieces 56B are adjacent to each other.

As the key top 2 is pressed down against the elastic urging force of the plate springs 55 of the cam members 52, the cam surfaces 56A of the cam members 52 attached to the first and second link members 3 and 4 respectively are gradually separated from the first contact state. Simultaneously, the engagement pieces 56B of the first and second link members 3 and 4 are rotated about the upper edges of the opposite cam surfaces 56A, serving as a fulcrum, in opposite directions (i.e., toward the opposite link member side). The engagement piece 56B of the first link member 3 side then acts as a second cam surface connected to the cam surface 56A of the second link member 4 side acting as a first cam surface of the second link member 4 side. Similarly, the engagement piece 56B of the second link member 4 side acts as a second cam surface connected to the cam surface 56A of the first link member 3 side acting as a first cam surface of the first link member 3 side. Each of the upper edges of the can surfaces 56A of the first and second link members 3 and 4 acts as a cam apex.

When the engagement pieces 56B of the first and second link members 3 and 4 are rotated by a predetermined amount in opposite directions about the upper edges of the opposite cam surfaces 56A acting as a fulcrum, the cam members 52 shifts to the second contact state. In this second contact state, the key top 2 is moved down to the pressed position, and the elastic resinous part 53 of the joint portion 30 of the second link member 4 presses from above the movable electrode pattern 13 of the upper film sheet 14 of the membrane switch sheet 7. Thus, the movable electrode pattern 13 is brought into contact with the fixed electrode pattern 10 of the lower film sheet 12 through the switching hole 15 of the film spacer 16, thereby conducting a predetermined switching operation.

Each plate member 29 is provided with a gear portion 36 arranged in a more end side than the third shaft 32 (i.e., in a left side in FIG. 18). The gear portion 36 includes one tooth or two teeth 36A. In FIG. 18, the left plate member 29 has the gear portion 36 of one tooth 36A and the right plate member 29 has the gear portion 36 of two teeth 36A. The gear portion 36, as mentioned above, engages with the gear portion 28 formed in the end of the plate member 18 of the first link member 3 to function for simultaneously operating the first and second link members 3 and 4 in association with the vertical movement of the key top 2.

In the key switch device 1 in the third emodiment, the elastic cam member 52 made of a thin plate made of stainless steel is attached to each of the first and second link members 3 and 4. Comparing with the case of the cam portion entirely made of resin, the cam member 52 is not be affected by the creep property which the resin inherently has and the degradation of heat-resistance. Accordingly, the key switch device 1 usable with a high reliability for a long term can be achieved.

When operating characteristics of the key switch device 1 are needed changing in accordance with various devices such as a personal computer and the like on which the key switch device 1 is to be mounted, it is sufficient to change the design of only the elastic cam member 52, not needing change of the design of the first and second link members 3 and 4. The thus common use of the first and second link members 3 and 4 having the same structure can eliminate waste.

Figure 19:
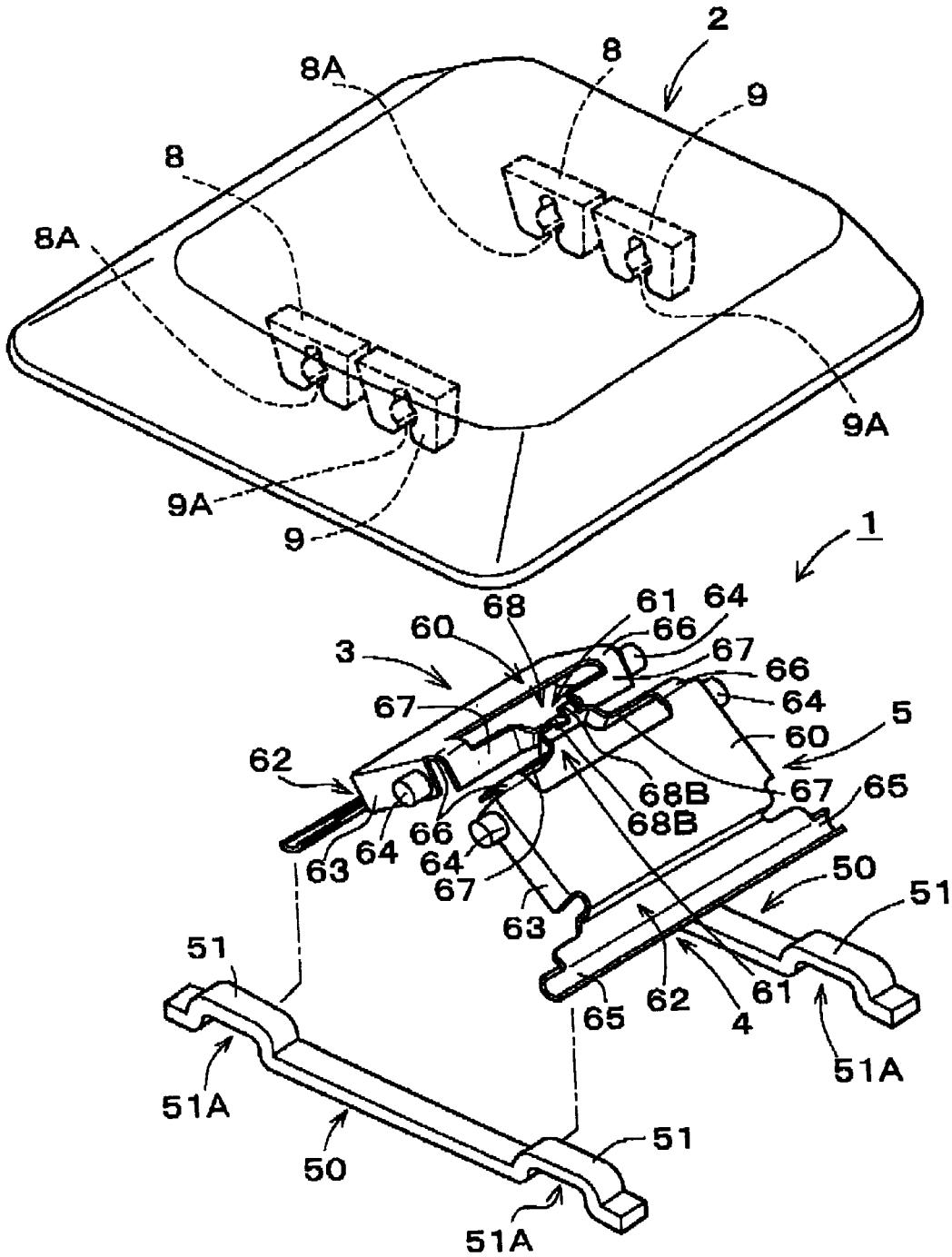
FIG. 19 is a schematic exploded view of a key top and a guide member of a key switch device in a fourth embodiment according to the present invention.
Figure 20A:
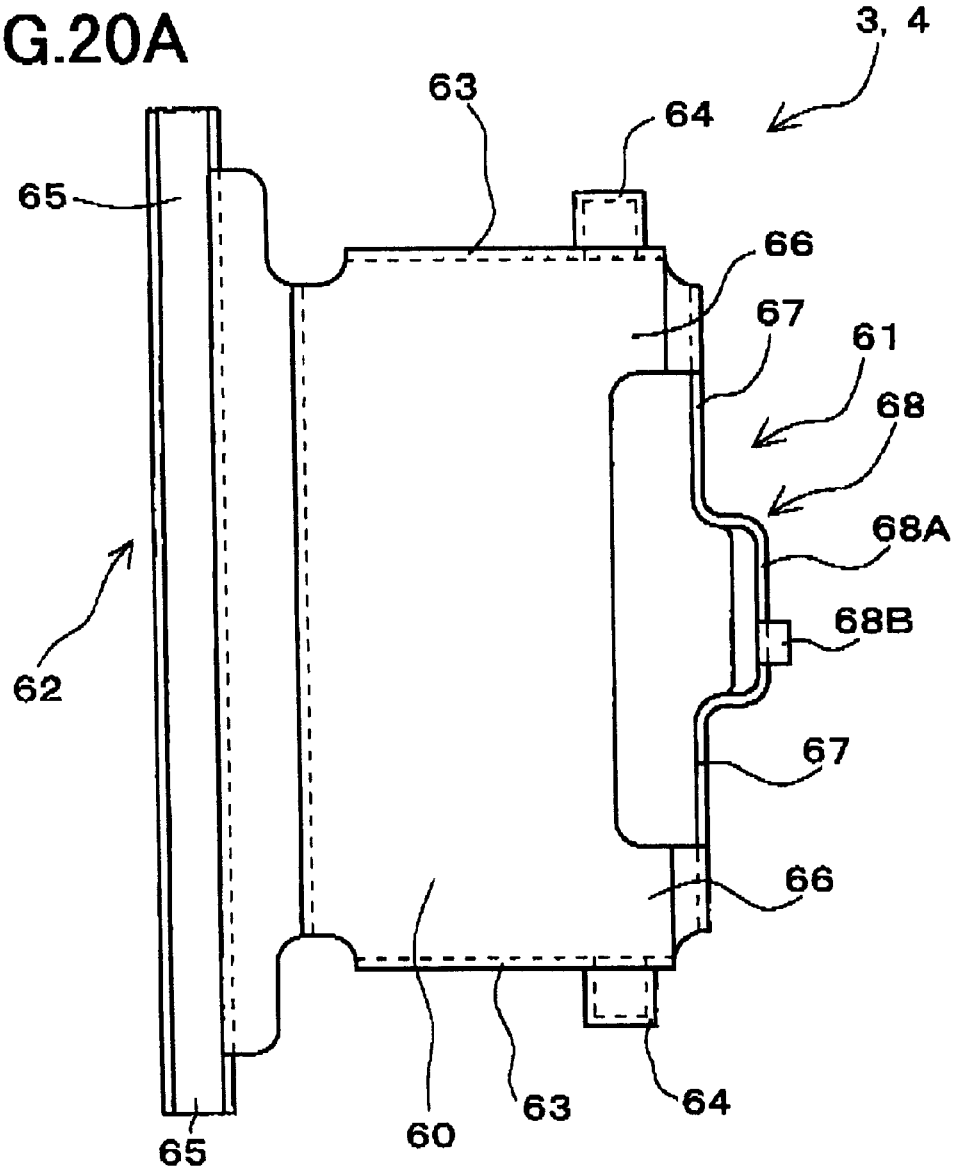
FIGS. 20A and 20B are a top view and a side view of a link member of the key switch device in the fourth embodiment.
Figure 20B:
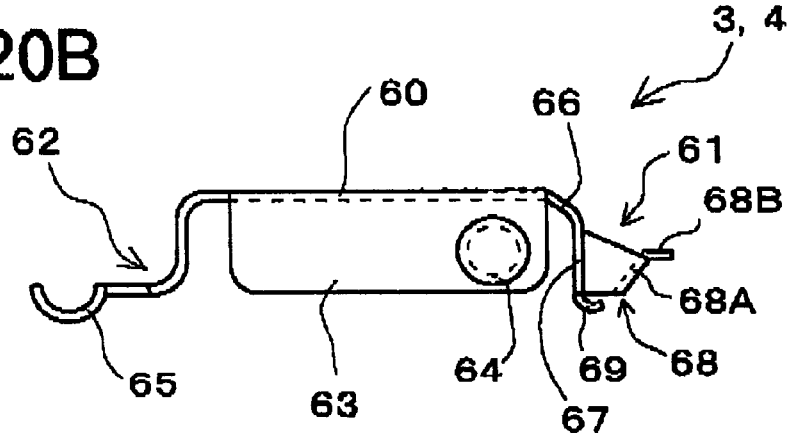

A key switch device in a fourth embodiment, provided in a keyboard 105 of the notebook-size personal computer mentioned above will be described below with reference to FIGS. 19 and 20. FIG. 19 is a schematic exploded view of a key top and a guide member of the key switch device in the fourth embodiment and FIGS. 20A and 20B are a top view and a side view of a link member of the key Switch device in the fourth embodiment.

The key switch device in the fourth embodiment has substantially the same structure as that in the third embodiment. A difference from the third embodiment is in only that the first and second link members configuring the guide member are each entirely formed of a metallic thin plate in one piece. The other elements are the same as in the third embodiment. Therefore, like elements are given like reference numbers and the detailed explanation thereof is omitted in the fourth embodiment. Only the feature in the fourth embodiment is explained below.

In FIGS. 19 and 20, the first and second link members 3 and 4 constituting the guide member 5 are the same in structure. The first link member 3 is formed of a metallic thin plate, Each as stainless steel or the like, in one piece. The first link member 3 is mainly constructed of a base part 60, an elastic cam part 61 connected to one side (an upper side in FIG. 19) of the base part 60, and a shaft forming part 62 connected to the other side (a lower side in FIG. 19) of the base part 60.

The base part 60 has a flat plate shape with plate parts 63 bent from both sides of the base part 60. A first shaft 64 is provided in each of the plate parts 63 so as to extend outward at a position near one end side of the plate part 63 (i.e., in an upper end side in FIG. 19). The first shaft 64 of the first link member 3 is rotatably engaged in a recess 8A of an engagement portion 8 of the key top 2.

The shaft forming part 62 is provided with an arc shaped portion in the side edge (lower edge), both ends of which configure second shafts 65 extending outward. The second shaft 65 is slidably engaged in a recess 51A of an engagement portion 51 of an engagement member 50 adhered on the upper surface of the upper film sheet 14 of the membrane switch sheet 7.

The engagement member 50 has the same structure as that used in the third embodiment, and the explanation thereof is omitted in the present embodiment.

The elastic cam part 61 is formed into one body with the base part 60 through a pair of joint parts 66. The elastic cam part 61 is constructed of a plate spring portion 67 connected to the joint parts 66 and a cam portion 68 formed projecting from the plate spring portion 67.

The plate spring portion 67 bent from the corresponding joint parts 66 produces spring elasticity. The cam portion 68 is rectangularly projected outwards in the substantial center of the plate spring portion 67. This cam portion 68 is constructed of a cam surface 68A configuring a first cam surface and an engagement piece 68B formed upwards at a predetermined inclination angle on the upper edge of the cam surface 68A. The engagement piece 68B is arranged at a slightly displaced position (rightwards or leftwards in FIGS. 19) from the center of the cam surface 68A. A pressing part 69 used for a switching operation on the membrane switch sheet 7 is provided at a lower end of the cam portion 68.

It is to be noted that the structure of the second link member 4 is substantially the same as that of the first link member 3 mentioned above, and the explanation is omitted.

Explanation is made on the engagement relationship between the first and second link members 3 and 4, referring to FIG. 19. In FIG. 19, when the first and second link members 3 and 4 are assembled to form the guide member 5, the cam surfaces 68A of the elastic cam parts 61 of the first and second link members 3 and 4 are in contact with each other by the elastic urging force of the respective plate spring portions 67. This state is regarded as a first contact state. In this first contact state, the key top 2 is securely held in the non-pressed position. Since the engagement piece 68B of the elastic cam portion 68 is slightly displaced from the center of the cam surface 68A, the engagement piece 68B of the elastic cam portion 68 of the first link member 3 and the engagement piece 68B of the second link member 4 are engaged with the upper edges of the opposite cam surfaces 68A respectively so that the pieces 68B are adjacent to each other.

As the key top 2 is pressed down against the elastic urging force of the plate spring portions 67, the cam surfaces 68A of the cam portions 68 of the first and second link members 3 and 4 are gradually separated from each other, so that the engagement pieces 68B of the first and second link members 3 and 4 are rotated about the upper edges of the opposite cam surfaces 68A, serving as a fulcrum, in opposite directions (i.e., toward the opposite link member side). The engagement piece 68B of the first link member 3 side then acts as a second cam surface connected to the cam surface 68A of the second link member 4 side acting as a first cam surface of the second link member 4 side. Similarly, the engagement piece 68B of the second link member 4 side acts as a second cam surface connected to the cam surface 68A of the first link member 3 side acting as a first cam surface of the first link member 3 side. Each of the upper edges of the cam surfaces 68A of the first and second link members 3 and 4 acts as a cam apex.

When the engagement pieces 68B of the first and second link members 3 and 4 are rotated by a predetermined amount in opposite directions about the upper edges of the opposite cam surfaces 68A acting as a fulcrum, the cam parts 61 shift to the second contact state. In this second contact state, the key top 2 is moved down to the pressed position, and the pressing part 69 provided in the cam portion 68 of the first link member 3 or the second link member 4 presses from above the movable electrode pattern 13 of the upper film sheet 14 of the membrane switch sheet 7. Thus, the movable electrode pattern 13 is brought into contact with the fixed electrode pattern 10 of the lower film sheet 12 through the switching hole 15 of the film spacer 16, thereby conducting a predetermined switching operation.

In the key switch device 1 in the fourth embodiment, each of the first and second link members 3 and 4 is made of a thin plate of stainless steel and provided with the elastic cam part urn 61 in a single-piece configuration. Like in the third embodiment, comparing the case of the cam entirely made of resin, the cam part is not affected by the creep property which the resin inherently has and the degradation of heat-resistance. Accordingly, the key switch device 1 usable with a high reliability for a long term can be achieved.

Figure 21:
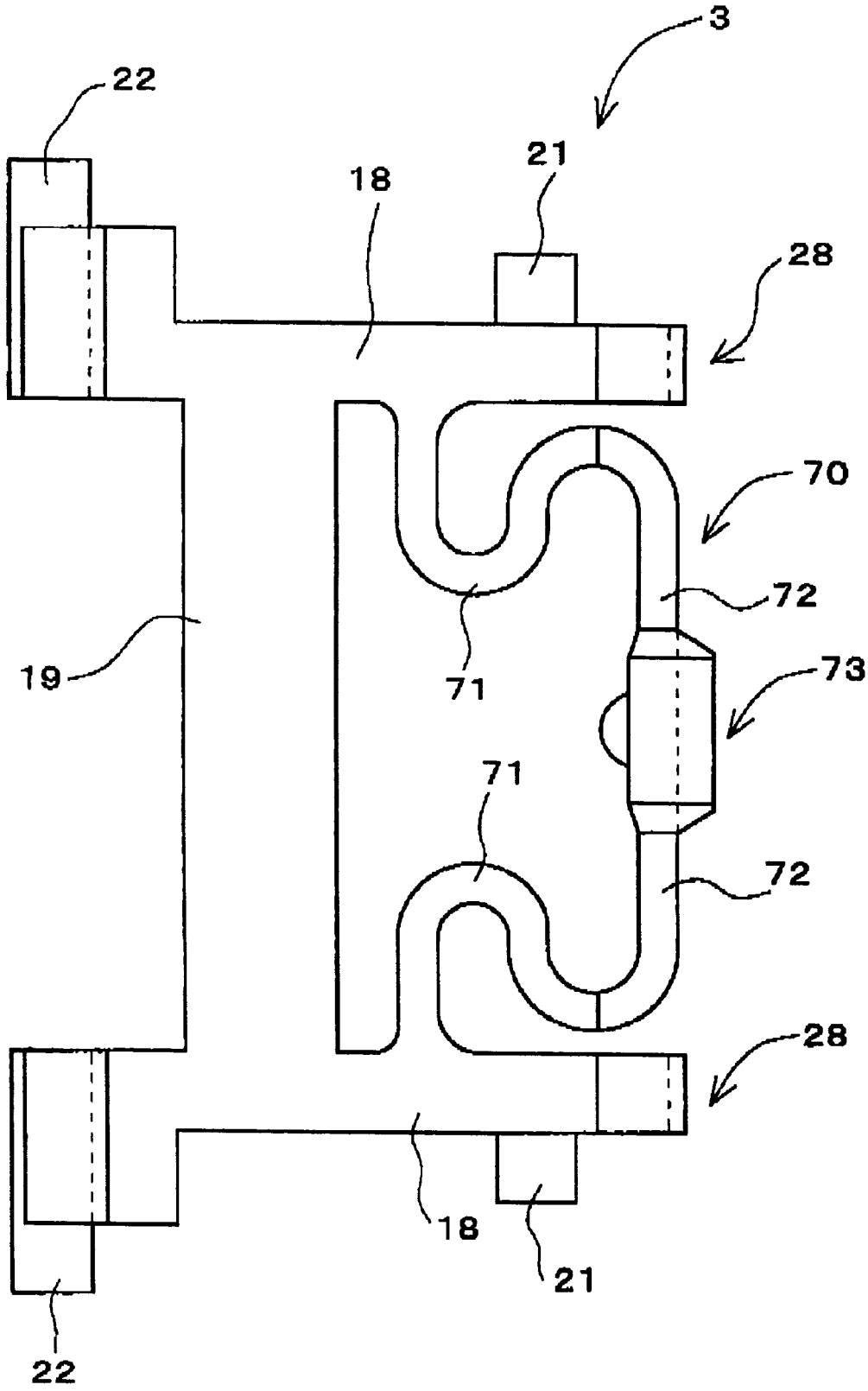
FIG. 21 is a top view of a link member used in a key switch device in a fifth embodiment according to the present invention.
Figure 22:
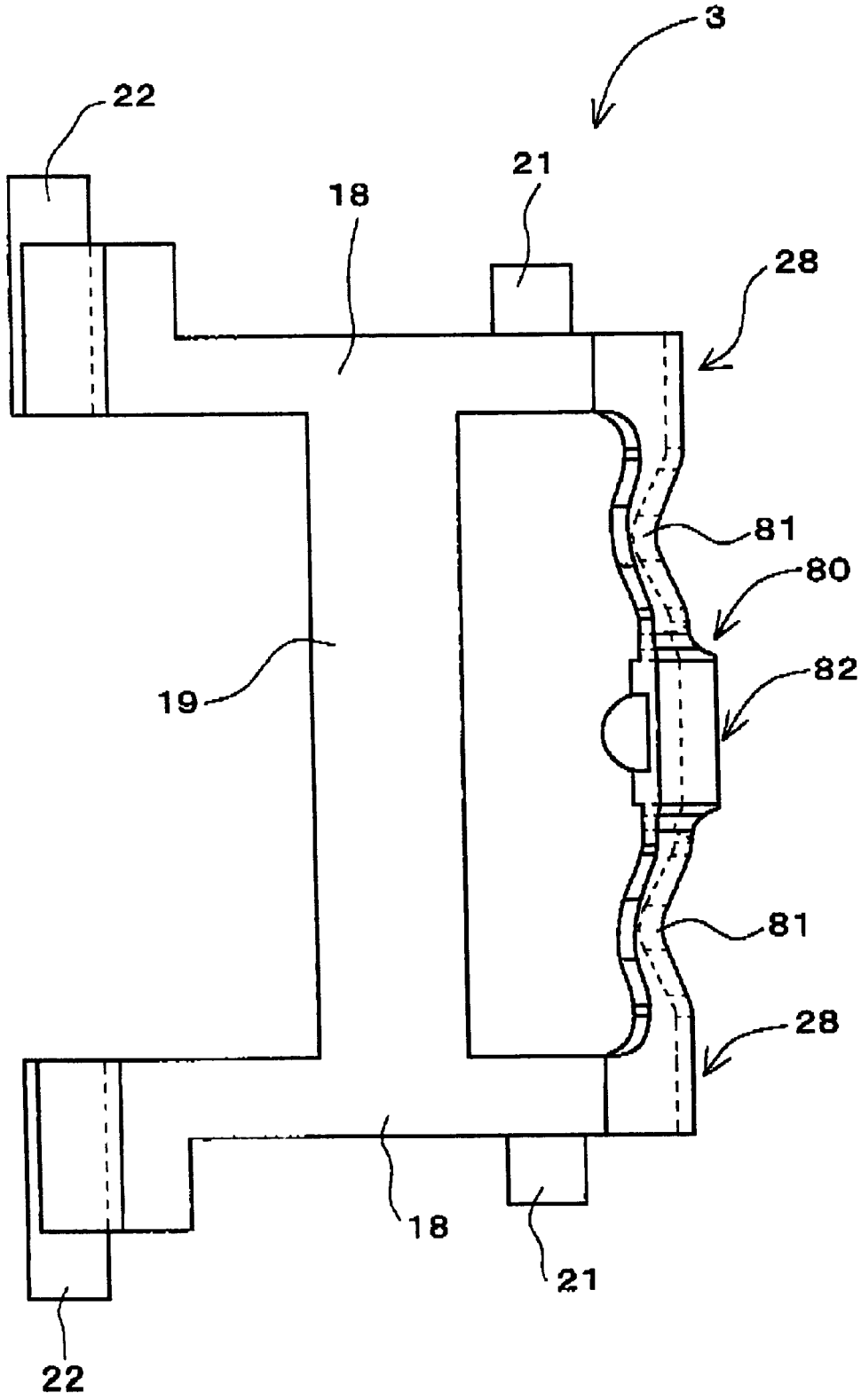
FIG. 22 is a top view of a link member used in a key switch device in a sixth embodiment according to the present invention.

Next, a key switch device in a fifth and sixth embodiments with reference to FIGS. 21 and 22 respectively. FIG. 21 is a top view of a link member used in the key switch device in the fifth embodiment. FIG. 22 is a top view of a link member used in the key switch device in the sixth embodiment.

The key switch device in the fifth embodiment is substantially identical in structure to the key switch device 1 in the first embodiment except for the following points. In the first embodiment, a straight plate spring having a cam is integrally provided between the plate members of the first and second link members. In this regard, the key switch devices in the fifth and sixth embodiments differ from the first embodiment. That is, in the key switch device in the fifth embodiment is provided with a substantially S-shaped spring portion arranged between plate members of each link member. In the key switch device in the sixth embodiment is provided with a substantially bow-shaped spring portion arranged between plate members of each link member. The other elements have the same structure as those in the first embodiments. Therefore, like elements are given like reference numbers and the detailed explanation thereof is omitted in the following embodiments. Only the features in the fifth and sixth embodiments are explained below.

At first, the structures of the first and second link members 3 and 4 used in the key switch device in the fifth embodiment are described below with reference to FIGS. 21. It is to be noted that the first link member 3 and the second link member 4 are the same in structure, and only the first link member 3 is described.

In the first link member 3 shown in FIG. 21, a spring part 70 arranged between a pair of plate members 18 and made into one body with the plate members 18. This spring part 70 is constructed of an S-shaped portion 71 connected to the plate member 18 and a bar portion 72 connecting both ends of the S-shaped portions 71. Like in the first embodiment, the bar portion 72 is provided with a cam part 73 having a first and second cam surfaces.

The spring part 70 elastically urges the cams 73 of the first and second link members 3 and 4 to come into contact with each other. A portion connecting the plate member 19 and the spring part 70 receives a tensile stress every time a switching operation is conducted. If the spring part is made in a simple straight form, the connecting portion between such the straight spring part and the plate member 18 would easily be affected by the tensile stress. However, in the present embodiment, the plate member 18 and the spring part 70 is connected through the S-shaped portion 71, so that the tensile stress to be exerted on the connecting portion between the plate member 18 and the spring part 70 is eased through the S-shaped portion 71. Accordingly, even if a switching operation is repeated for a long term, creep deformation in the spring part 70 would not occur. Thus, the key switch device with improved durability can be realized.

The structures of the first and second link members 3 and 4 used in the key switch device in the sixth embodiment are described below with reference to FIG. 22. It is to be noted that the first link member 3 and the second link member 4 are the same in structure, and only the first link member 3 is described.

In the first link member 3 shown in FIG. 22, a bow-shaped spring part 80 arranged between a pair of plate members 18 and made into one body with the plate members 18. This spring part 80 is constructed of a curved portion 81 connected to the plate member 18 and a cam portion 82 connecting both ends of the curved portions 81. Like in the first embodiment, the cam portion 82 is provided with a first and second cam surfaces.

The spring part 80 elastically urges the cam portions 82 of the first and second link members 3 and 4 to come into contact with each other. A portion connecting the plate member 18 and the spring part 80 receives a tensile stress every time a switching operation is conducted. If the spring part in made in a straight form, the connecting portion between such the straight spring part and the plate member 18 would easily be affected by the tensile stress. However, in the present embodiment, the plate member 18 and the spring part 80 is connected through the curved portion 81, so that the tensile stress to be exerted on the connecting portion between the plate member 18 and the curved portion 81 is eased through the curved portion 81. Accordingly, even if a switching operation is repeated for a long term, creep deformation in the spring part 80 would not occur. Thus, the key switch device with improved durability can be realized.

Figure 23:
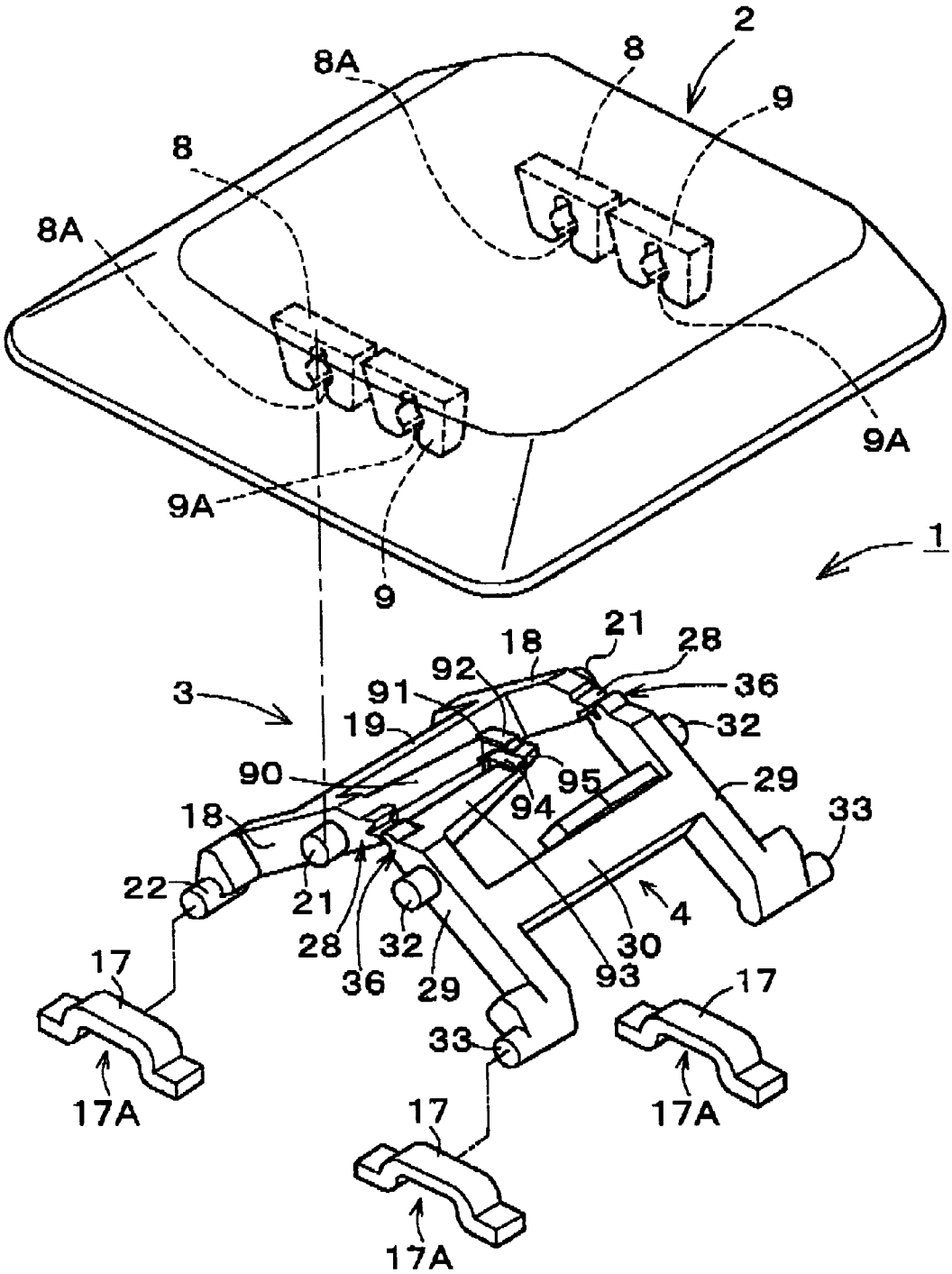
FIG. 23 is a perspective exploded view of a modified form of a key top and a guide member of the key switch device in the first embodiment.

Next, a modified form of the first embodiment is described with reference to FIG. 23. FIG. 23 is a perspective exploded view of the modified form of a key top and a guide member of the key switch device in the first embodiment.

The key switch device shown in FIG. 23 is substantially identical in structure to that in the first embodiment. In this modification, differing from the first embodiment wherein a plate spring having a cam portion is provided between the plate members of each of the first and second link members, each link member is provided with a spring part made in the form of a cantilever extending from one of plate members. The other elements are the sate as in the first embodiment. Therefore, like elements are given like reference numbers and the detailed explanation thereof is omitted in this modification. Only the feature in the modified form is explained below.

In FIG. 23, a plate spring 90 is integrally provided in a left one (in FIG. 23) of a pair of plate members 18 provided in the first link member 3. The plate spring 90 is arranged near a gear portion 28 of the plate member 18 and formed in a cantilever extending inwards. Like in the first embodiment, the plate spring 90 has a first and second cam portions 91 and 92 having a first and second cam surfaces respectively.

A plate spring 93 is integrally provided in a left one (in FIG. 23) of a pair of plate members 29. The plate spring 93 is arranged near a gear portion 36 of the plate member 29 and formed in a cantilever extending inwards Like in the first embodiment, the plate spring 93 has a third and fourth cam portions 94 and 95 having a first and second cam surfaces respectively.

The first cam portion 91 of the plate spring 90 of the first link member 3 is in contact with the third cam portion 94 of the plate spring 93 of the second link member 4 by the elastic urging force of the plate springs 90 and 93, while the second cam portion 92 of the plate spring 90 of the first link member 3 is in contact with the fourth cam portion 95 of the plate spring 93 of the second link member 4 by the elastic urging force of the plate springs 90 and 93.

As mentioned above, the first and second link members 3 and 4 constructed such that the plate springs 90 and 93 are in the form of a cantilever extending from one of the plate members 18 or 29 can provide substantially the same fundamental function as in the first embodiment. The modified form shown in FIG. 23 can achieve the same effect as in the first embodiment.

The present invention are not limited to the above first to sixth embodiments and may be embodied in other specific forms without departing from the spirit or essential characteristics thereof. For instance, in the above first and second embodiments, as shown in FIG. 6, the projection 27A is provided throughout the width of the cam apex 27 of the first cam portion 24 of the first link member 3, while the groove 27B which engages with the projection 27A is provided in the cam apex 27 of the second cam portion 35 of the second link member 4. Instead thereof, a projection 27A and a groove 27B may be formed in a side-by-side configuration at the cam apex 27 of the first cam portion 24 of the first link member 3 or the second link member 4. Such the link member can be used in common as any of the first and second link members 3 and 4 and also can provide synchronization between the link members.

In the above embodiments, both the elastic resinous piece 24A formed at the lower end of the first cam portion 24 and the elastic resinous piece 35A formed at the lower end of the second cam portion 35 are used to conduct a switching operation on the membrane switch sheet 7. Any one of the resinous pieces 24A and 35A may be eliminated.

Figure 25:
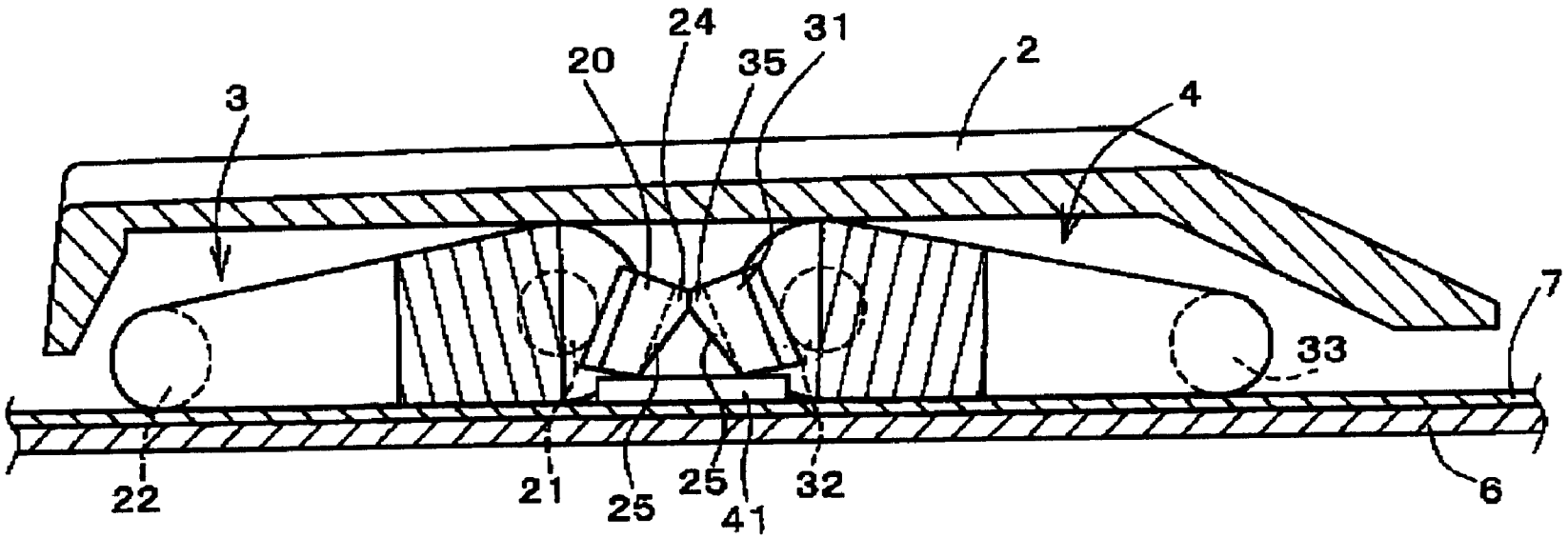
FIG. 25 is a schematic sectional side view of a first modified form of the key switch device in the first and second embodiment.

As shown in FIG. 25, a micro rubber spring 41 may be adhered on the membrane switch sheet 7 in correspondence with the switching area. The lower ends of the first and second cam portions 24 and 35 press the micro rubber spring 41 upon pressure of the key top 2, thereby conducting a switching operation on the membrane switch sheet 7. In this case, an overtravel property can be obtained due to the micro rubber spring 41.

Figure 26:
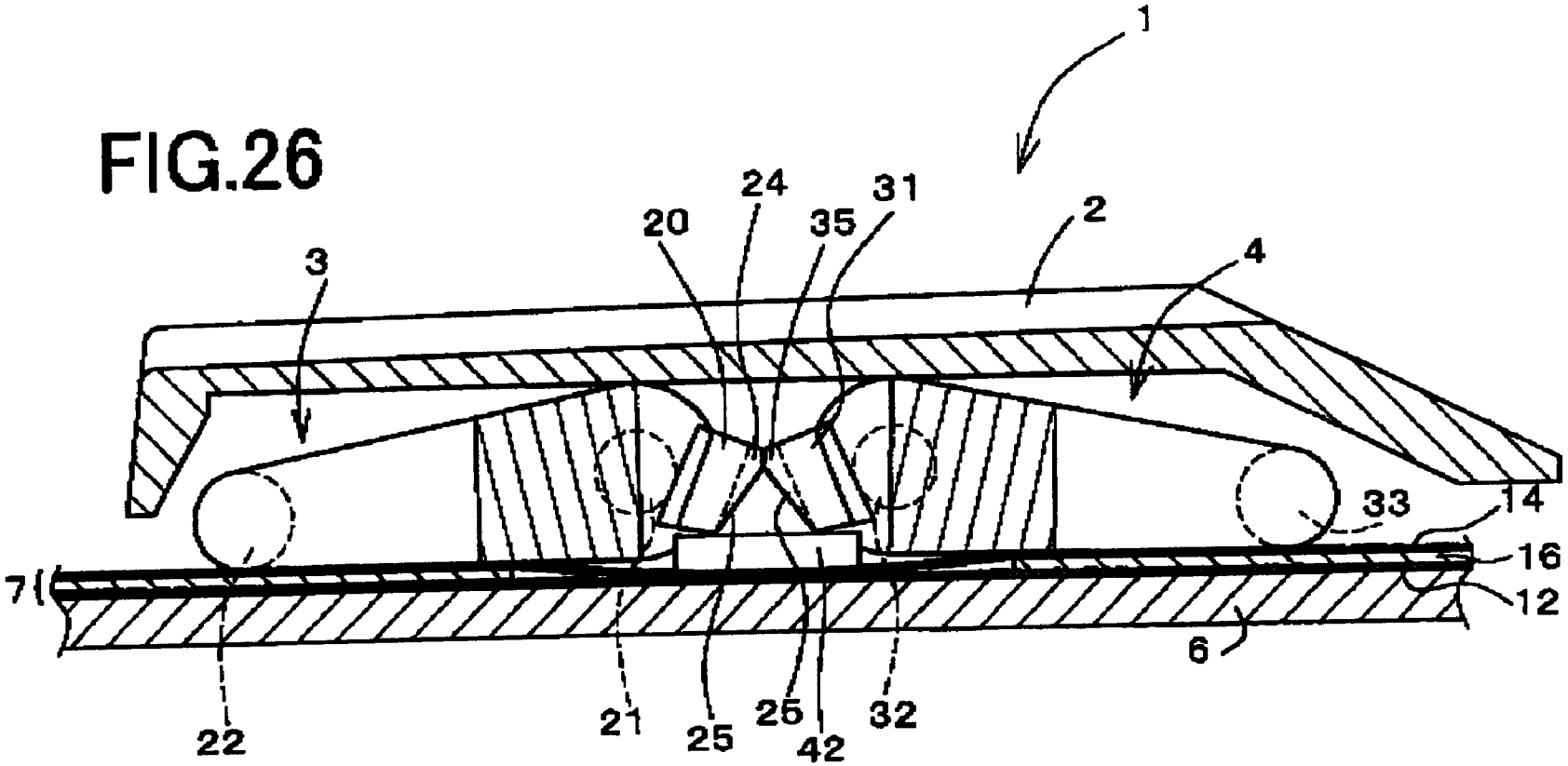
FIG. 26 is a schematic sectional side view of a second modified form of the key switch device in the first and second embodiment.

As shown in FIG. 26, furthermore, an elastic sheet 42 made of rubber and the like may be adhered on the membrane switch sheet 7 in correspondence with the switching area. The lower ends of the first and second cam portions 24 and 35 press the elastic sheet 42 upon pressure of the key top 2, conducting a switching operation on the membrane switch sheet 7. In this case, an overtravel property can be obtained when the elastic sheet 42 is elastically deformed by the lower ends of the first and second cam portions 24 and 35.

Figure 27A:
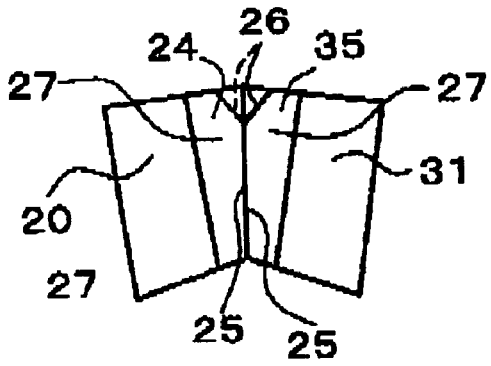
FIGS. 27A through 27C are explanatory views of a first modified form of the first and second cam portions.

As shown in FIGS. 27A–2C, it may be configured such that the first cam portion 24 has a sloped portion having a first cam surface 25 and a recessed portion having a second cam surface 26, while the second cam portion 35 has a contact portion which has a first cam surface 25 and comes into contact with the sloped portion and a projected portion which comes into contact with the recessed portion. In this case,the first and second cam portions 24 and 35 can be fully synchronized to operate.

Figure 28A:
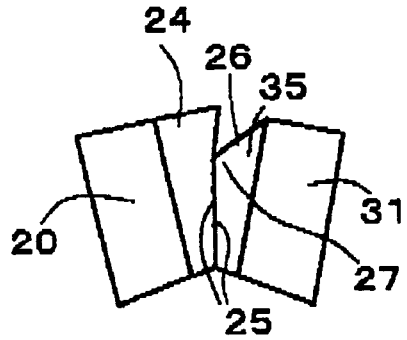
FIGS. 28A through 28C are explanatory views of a second modified form of the first and second cam portions.
Figure 28B:
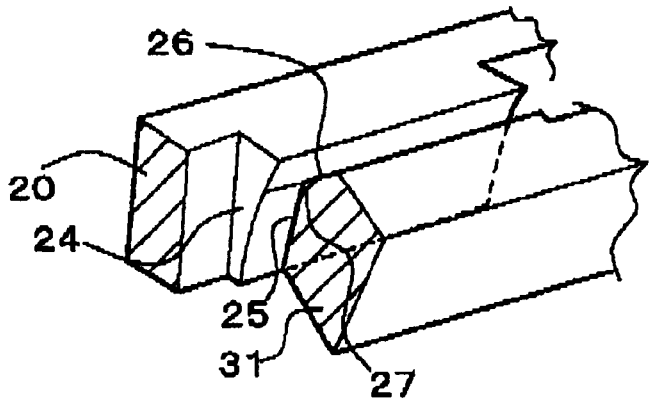
Figure 28C:
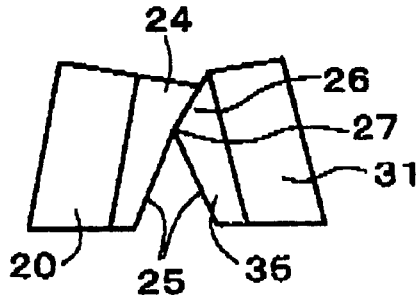

As shown in FIGS. 28A–28C, it may be configured such that the first cam portion 24 has a first cam surface 25 and a restrictive surface, while the second cam portion 35 has a first and second cam surfaces 25 and 26. In this case, upon pressure of the key top 2, the restrictive surface of the first cam portion 24 is made into contact with the second cam surface 26 of the second cam portion 35. With such the configuration, the first and second cam portions 24 and 35 can be synchronized to operate.

Figure 27B:
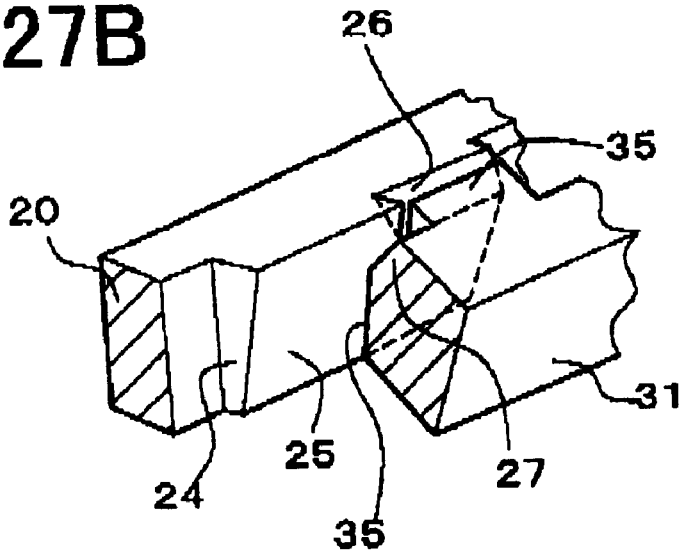
Figure 27C:
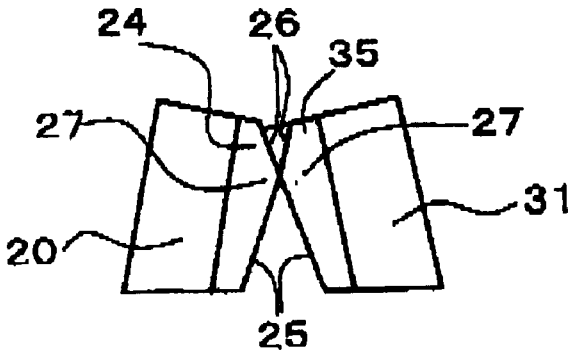
Figure 29A:
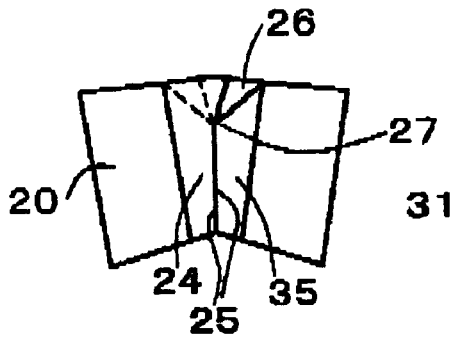
FIGS. 29A through 29C are explanatory views of a third modified form of the first and second cam portions.
Figure 29B:
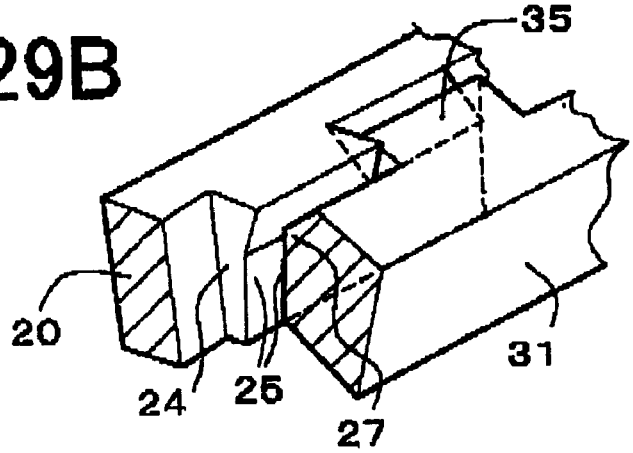
Figure 29C:
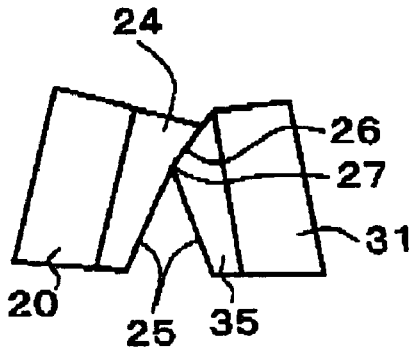

As shown in FIGS. 29A–29C, the configurations shown in FIGS. 27 and 28 may be combined. In this case, similarly, the first and second cam portions 24 and 35 can be synchronized to operate.

It is to be noted that the key switch device 1 constructed as above is provided in the keyboard 105 and used for input of data such as letters, symbols, and others into an electronic apparatus such as the personal computer 100. The data input through the keyboard 105 is displayed on the display 103 under control of the CPU 101.

In the above embodiments, the present invention is applied to a notebook-size personal computer, and, of course, may be applied to an electronic apparatus provided with a key switch device, for example, a typewriter, a word processor, and others.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A key switch device including a key top and a pair of first and second link members movably arranged under the key top, the first and second link members being used for guiding the key top to perform a switching operation on a switching section, the device further including:

a first cam portion formed in the first link member;

a second cam portion formed in the second link member; and an elastic portion formed in each of the first and second cam portions, for urging the first and second cam portions in a direction to come into contact with each other.

2. The key top switch device according to claim 1, wherein each of the first and second cam portions has a first and second cam surfaces, the first cam surface corresponding to a non-pressed position of the key top, and the second cam surface corresponding to a pressed position of the key top.

3. The key top switch device according to claim 2, wherein the first cam surface lies in a lower side in each of the first and second cam portions and the second cam surface lies continuously from the first cam surface in an upper side in each of the first and second cam portions.

4. The key top switch device according to claim 3, wherein each of the first and second can portions further has a cam apex at a boundary between the first and second cam surfaces, and when the key top is in the non-pressed position, the first and second cam portions are in a first contact state where the first cam surface of the first cam portion and the first can surface of the second cam portion are in contact with each other by an urging force of the elastic portions, and when the key top is pressed down to the pressed position, the first and second cam portions are moved against the urging force of the elastic portions, passing the cam apexes, to a second contact state where the second cam surface of the first cam portion and the second cam surface of the second cam portion are made into contact with each other.

5. The key switch device according to claim 4, wherein the key top is pressed down with a click when the first and second cam portions are moved against the urging force of the elastic portions from the first contact state, passing the cam apexes, to the second contact state.

6. The key switch device according to claim 4, wherein an angle defined by the first cam surface, the cam apex, and the second cam surface is an obtuse angle.

7. The key switch device according to claim 1, wherein each of the first and second link members is made of resin in one piece, and the elastic portion comprises a plate spring.

8. The key switch device according to claim 4, wherein the cam apex of one of the first and second cam portions is provided with a projection, while the cam apex of the other of the first and second cam portions is provided with a groove that engages with the projection.

9. The key switch device according to claim 8, wherein the projection and the groove are held in an engagement relationship at all times from the first contact state to the second contact state by the urging force of the elastic portions of the first and second cam portions.

10. The key switch device according to claim 1, further including:

first engagement portions provided on a back surface of the key top;

second engagement portions for engaging a support plate arranged below the key top;

a first shaft corresponding to the first engagement portion and a second shaft corresponding to the second engagement portion, the first and second shafts being provided in the first link member;

a third shaft corresponding to the first engagement portion and a fourth shaft corresponding to the second engagement portion, the third and fourth shafts being provided in the second link member;

wherein the first and third shafts are rotatably engaged in the first engagement portions, and the second and fourth shafts are slidably engaged in the second engagement portions.

11. The key switch device according to claim 1, further including:

first engagement portions provided on a back surface of the key top;

second engagement portions for engaging a support plate arranged below the key top;

a first shaft corresponding to the first engagement portion and a second shaft corresponding to the second engagement portion, the first and second shafts being provided in the first link member;

a third shaft corresponding to the first engagement portion and a fourth shaft corresponding to the second engagement portion, the third and fourth shafts being provided in the second link member;

wherein the first and third shafts are rotatably engaged in the first engagement portions, the second shaft is slidably engaged in the second engagement portion, and the fourth shaft is rotatably engaged in the second engagement portion.

12. The key switch device according to claim 10, wherein a distance from a center of each of the first and third shafts to the second cam surface is set to be larger than a distance from the center of each of the first and third shafts to the first cam surface.

13. The key switch device according to claim 10, wherein the switching section is constructed of a membrane switch sheet arranged on the support plate, and a switching operation is performed on the membrane switch sheet by means of at least one of the first cam portion and the second cam portion upon pressure of the key top.

14. The key switch device according to claim 13, wherein the second engagement portion is constructed of a chipped engagement member adhered to an upper surface of the membrane switch sheet.

15. The key switch device according to claim 10, wherein the first cam portion is provided with a first elastic piece and the second cam portion is provided with a second elastic piece, and the first and second elastic pieces serve to press almost together the membrane switch sheet.

16. The key switch device according to claim 10, wherein the first cam portion is provided with a first elastic piece and the second cam portion is provided with a second elastic piece, and the first and second elastic pieces serve to press sequentially one after another the membrane switch sheet.

17. The key switch device according to claim 10, wherein one of the first and second cam portions performs a switching operation on the membrane switch sheet before the first and second cam portions are moved to the second contact state from the first contact state, passing the cam apexes, upon pressure of the key top.

18. The key switch device according to claim 1, wherein the first and second cam portions are arranged at opposite positions in the first and second link member respectively, and the elastic portions are arranged adjacently to the first cam portion and the second cam portion.

19. The key switch device according to claim 1, further comprising:

a first elastic cam member detachably attached to the first link member;

a second elastic cam member detachably attached to the second link member;

wherein the first cam portion and the elastic portion of the first link member are formed in the first elastic cam member and the second cam portion and the elastic portion of the second link member are formed in the second elastic cam member.

20. The switch device according to claim 19, wherein each of the first and second elastic cam members is made of an elastic thin plate.

21. The key switch device according to claim 19, wherein each of the first and second cam portions is provided with a cam surface configuring a first cam surface and an engagement piece configuring a second cam surface, the engagement piece being formed continuously from the cam surface at a predetermined inclination angle.

22. The key switch device according to claim 1, wherein the first link member with the first cam portion and the elastic portion is made of an elastic thin plate in one piece, and the second link member with the second cam portion and the elastic portion is made of an elastic thin plate in one place.

23. The key switch device according to claim 22, each of the first and second cam portions is provided with a cam surface configuring a first cam surface and an engagement piece configuring a second cam surface, the engagement piece being formed continuously from the cam surface at a predetermined inclination angle.

24. The key switch device according to claim 1, wherein the first link member has a pair of first plate members and the second link member has a pair of second plate members, wherein the elastic portion in the first link member comprises a first plate spring integrally formed in one of the first place members in the first link member, the first plate spring being formed in a cantilever so as to extend between the first place members, and the elastic portion in the second link member comprises a second plate spring integrally formed in one of the second plate members in the second link member, the second plate spring being formed in a cantilever so as to extend between the second plate members, and wherein the first cam portion is formed at an end of the first plate spring and the second portion is formed at an end of the second plate spring, and the first and second cam portions come into contact with each other by urging forces of the first and second plate springs.

25. The key switch device according to claim 1, wherein each of the first and second link members includes a pair of plate members and a curved spring provided between the plate members.

26. The key switch device according to claim 25, wherein the spring includes an S-shaped portion.

27. The key switch device according to claim 25, wherein the spring includes a bow-shaped portion.

28. A keyboard to be used for inputting letters, symbols, and others, the keyboard including a key switch device that includes:

a key top;

a pair of first and second link members movably arranged under the key top, the first and second link members being used for guiding the key top to perform a switching operation on a switching section;

a first cam portion formed in the first link member;

a second cam portion formed in the second link member; and an elastic portion formed in each of the first and second cam portions, for urging the first and second cam portions in a direction to come into contact with each other.

29. An electronic apparatus including:

a keyboard used for inputting letters, symbols, and others, the keyboard being provided with a key switch device that includes:

a key top;

a pair of first and second link members movably arranged under the key top, the first and second link members being used for guiding the key top to perform a switching operation on a switching section;

a first cam portion formed in the first link member;

a second cam portion formed in the second link member; and an elastic portion formed in each of the first and second cam portions, for urging the first and second cam portions in a direction to come into contact with each other;

display means for displaying the letters, symbols, and others; and control means for controlling the display means to display the letters, symbols, and others based on input data from the keyboard.

* * * * *